US006281421B1

(12) United States Patent
Kawaguchi

(10) Patent No.: US 6,281,421 B1
(45) Date of Patent: Aug. 28, 2001

(54) REMIX APPARATUS AND METHOD FOR GENERATING NEW MUSICAL TONE PATTERN DATA BY COMBINING A PLURALITY OF DIVIDED MUSICAL TONE PIECE DATA, AND STORAGE MEDIUM STORING A PROGRAM FOR IMPLEMENTING THE METHOD

(75) Inventor: Yukihiro Kawaguchi, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/546,200

(22) Filed: Apr. 10, 2000

(30) Foreign Application Priority Data

Sep. 24, 1999 (JP) ..... 11-271399

(51) Int. Cl.[7] ..... G10H 1/057; G10H 1/26; G10H 1/46; G10H 7/02

(52) U.S. Cl. ..... 84/603; 84/609; 84/649; 84/663; 84/665

(58) Field of Search ..... 84/603–607, 609–614, 84/634–638, 649–652, 666–669, 663, 665

(56) References Cited

U.S. PATENT DOCUMENTS

| | | | | |
|---|---|---|---|---|
| 4,524,666 | | 6/1985 | Kato . | |
| 4,785,702 | | 11/1988 | Katoh . | |
| 5,369,217 | * | 11/1994 | Yamashita et al. | 84/611 |
| 5,461,190 | * | 10/1995 | Terada | 84/609 |
| 5,492,049 | * | 2/1996 | Aoki et al. | 84/611 |
| 5,877,445 | * | 3/1999 | Hufford et al. | 84/609 X |
| 5,952,598 | * | 9/1999 | Goede | 84/609 |
| 5,973,255 | * | 10/1999 | Tanji | 84/636 |
| 5,990,404 | * | 11/1999 | Miyano | 84/609 |
| 5,990,406 | * | 11/1999 | Nakamura et al. | 84/609 |

FOREIGN PATENT DOCUMENTS 6-95668 4/1994 (JP) .

* cited by examiner

*Primary Examiner*—Stanley J. Witkowski
(74) *Attorney, Agent, or Firm*—Morrison & Foerster

(57) ABSTRACT

A remix apparatus and a remix method are provided, which can generate new musical tone pattern data with new tempo and groove while partly maintaining the tempo and groove of the original musical tone pattern data. Musical tone pattern data having a first predetermined length are divided into a plurality of first musical tone piece data each having a second predetermined length smaller than the first predetermined length, and the musical tone pattern data are divided into second musical tone piece data each having a third predetermined length smaller than the first predetermined length and different from the second predetermined length. Based on a rearranging pattern indicative of an arrangement of lengths of ones of musical tone piece data obtained by the division to be rearranged in rearranging the musical tone piece data, new musical tone pattern data are generated by selecting and rearranging at least one of the plurality of second musical tone piece data in at least one position for which the rearranging pattern indicates the second predetermined length, and selecting and rearranging at least one of the plurality of first musical tone piece data in at least one position for which the rearranging pattern indicates the second predetermined length.

28 Claims, 16 Drawing Sheets

*FIG.4*

| | | | | | | | | |
|---|---|---|---|---|---|---|---|---|
| PATTERN A | 2 | 1 | 2 | 1 | 2 | | | |
| PATTERN B | 2 | 1 | 1 | 2 | 1 | 1 | | |
| PATTERN C | 2 | 1 | 1 | 2 | 1 | 0.5 | 0.5 | |
| PATTERN D | 1 | 1 | 1 | 2 | 1 | 1 | 1 | |
| PATTERN E | 0.5 | 0.5 | 0.5 | 0.5 | 1 | 0.5 | 1 | 0.5 | 2 |
| PATTERN F | 1 | 1 | 1.5 | 0.5 | 1.5 | 0.5 | 1 | 0.5 | |
| PATTERN G | 0.5 | 0.5 | 0.25 | 0.25 | 0.25 | 0.25 | 0.25 | 1 | 0.5 | 0.5 | 1 | 1 |
| PATTERN H | 2 | 1 | 1 | 0.5 | 0.5 | 0.5 | 0.5 | 0.25 | 0.25 | 0.25 | 0.25 | 0.25 | 0.25 | 0.25 |

FIG.6

| | |
|---|---|
| RATIO A | null |
| RATIO B | (1,1),(3,1),(5,1) |
| RATIO C | (1,1),(2,1),(5,1),(12,1) |
| RATIO D | (1,1),(5,1),(10,1) |
| RATIO E | (2,1),(5,1) |
| RATIO F | (5,1),(15,1),(16,1) |
| RATIO G | (1,1),(3,2),(9,2) |
| RATIO H | (2,2),(4,3),(10,2) |
| RATIO I | (2,2),(5,0),(8,3),(11,0),(12,4) |
| RATIO J | (1,3),(5,2),(9,3),(10,4),(15,2) |

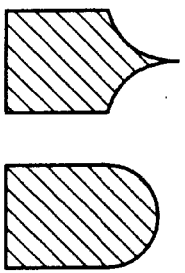
FIG.7A EXAMPLE OF PIECE REDUCTION
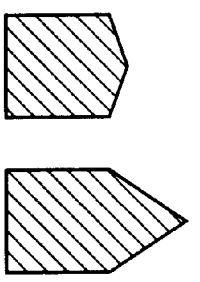
FIG.7B EXAMPLE OF ATTENUATION SPEED CHANGE
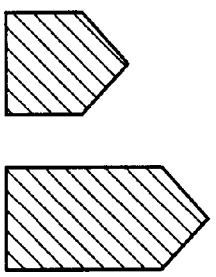
FIG.7C EXAMPLE OF ATTENUATION POSITION CHANGE
FIG.7D EXAMPLE OF ATTENUATION CURVE

REMIX APPARATUS AND METHOD FOR GENERATING NEW MUSICAL TONE PATTERN DATA BY COMBINING A PLURALITY OF DIVIDED MUSICAL TONE PIECE DATA, AND STORAGE MEDIUM STORING A PROGRAM FOR IMPLEMENTING THE METHOD

BACKGROUND OF THE INVENTION

1. Field of the Invention

The present invention relates to a remix apparatus and method for dividing previously generated musical tone pattern data into a plurality of musical tone data (hereinafter referred to as "musical tone piece data") and combining the musical tone piece data obtained by the division to generate new musical tone pattern data, and a storage medium storing a program for implementing the method.

2. Prior Art

A conventional remix apparatus for generating new musical tone pattern data from previously generated musical tone pattern data is known, for example, from Japanese Laid-Open Patent Publication (Kokai) No. 6-95668.

This remix apparatus designates ones of plural previously generated and stored musical tone pattern data which are to be selected as well as switching timing therefor and reads out the designated musical tone pattern data at the designated switching time to sequentially regenerate the data starting with the one indicated by the switching timing to thereby generate new musical tone pattern data.

With the above conventional remix apparatus, however, the newly generated musical tone pattern data is obtained by cutting out some of the plural musical tone pattern data and joining these data together, and each of the musical tone data constituting the new musical tone pattern data is located at the same position as the corresponding original musical tone pattern data. That is, the tempo (the tempo, as used herein, does not refer to the general tempo of performance but to the tempo in a local portion such as one beat) and groove of the newly generated musical tone pattern data still depend on the tempo and groove of the corresponding positions of the original plural musical tone pattern data. Thus, the conventional remix apparatus still has room for improvement on this point.

SUMMARY OF THE INVENTION

It is an object of the present invention to provide a remix apparatus and method that can generate new musical tone pattern data with new tempo and groove while partly maintaining the tempo and groove of the original musical tone pattern data, and a recording medium storing a program for implementing the method.

It is another object of the present invention to provide a remix apparatus and method that can generate musical tone pattern data with rhythmicity or rhythmical sense even from original musical tone pattern data which lack rhythmicity or rhythmical sense, and a recording medium storing a program for implementing the method.

It is a further object of the present invention to provide a remix apparatus and method that can generate new musical tone waveform data by processing harmonic characteristics of musical tone waveform data for use in a waveform memory tone generator, an FM (frequency modulation) tone generator, or the like, and a recording medium storing a program for implementing the method.

According to a first aspect of the present invention, there is provided a remix apparatus comprising a division device that divides musical tone pattern data having a first predetermined length into a plurality of first musical tone piece data each having a second predetermined length smaller than the first predetermined length, and divides the musical tone pattern data into a plurality of second musical tone piece data each having a third predetermined length smaller than the first predetermined length and different from the second predetermined length, and a generation device that operates based on a rearranging pattern indicative of an arrangement of lengths of ones of musical tone piece data obtained by division by the division device to be rearranged in rearranging the musical tone piece data, to generate new musical tone pattern data by selecting and rearranging at least one of the plurality of first musical tone piece data in at least one position for which the rearranging pattern indicates the second predetermined length, and selecting and rearranging at least one of the plurality of second musical tone piece data in at least one position for which the rearranging pattern indicates the third predetermined length.

According to a first aspect of the present invention, there is also provided a remix method comprising a division step of dividing musical tone pattern data having a first predetermined length into a plurality of first musical tone piece data each having a second predetermined length smaller than the first predetermined length, and dividing the musical tone pattern data into a plurality of second musical tone piece data each having a third predetermined length smaller than the first predetermined length and different from the second predetermined length, and a generation step of operating based on a rearranging pattern indicative of an arrangement of lengths of ones of musical tone piece data obtained by division by the division step to be rearranged in rearranging the musical tone piece data, to generate new musical tone pattern data by selecting and rearranging at least one of the plurality of first musical tone piece data in at least one position for which the rearranging pattern indicates the second predetermined length, and selecting and rearranging at least one of the plurality of second musical tone piece data in at least one position for which the rearranging pattern indicates the third predetermined length.

Thus, according to the first aspect, by changing the manner of dividing the musical tone piece data depending on the length of each part of the rearranging pattern, portions of the musical tone pattern from which sounds characteristic of this pattern are generated can be extracted and rearranged depending on the beats of the musical tone pattern data (for example, 4 beats, 8 beats, or 16 beats), thereby enabling the rearrangement of the musical tone piece data with the nuance of the original musical tone pattern data maintained.

According to a second aspect of the present invention, there is provided a remix device comprising a division device that divides musical tone data having a predetermined length into a plurality of musical tone piece data each having a length smaller than the predetermined length, a first selection device that selects one of a plurality of rearranging patterns each indicative of an arrangement of lengths of ones of musical tone piece data obtained by division by the division device to be rearranged in rearranging the musical tone piece data, a second selection device that selects one of a plurality of ratio patterns each indicative of positions of ones of the musical tone piece data obtained by division by the division device to be controlled in rearranging the musical tone piece data and also indicative of contents of control thereof, and a generation device that generates new musical tone pattern data by sequentially selecting ones of the plural musical tone piece data which have lengths indicated by the selected rearranging pattern, subjecting ones of the selected musical tone piece data which are located at positions indicated by the selected ratio pattern, to control having contents indicated by the selected ratio pattern, and then rearranging the controlled musical tone piece data.

According to the second aspect, there is also provided a remix method comprising a division step of dividing musical tone data having a predetermined length into a plurality of musical tone piece data each having a length smaller than the predetermined length, a first selection step of selecting one of a plurality of rearranging patterns each indicative of an arrangement of lengths of ones of musical tone piece data obtained by division by the division step to be rearranged in rearranging the musical tone piece data, a second selection step of selecting one of a plurality of ratio patterns each indicative of positions of ones of the musical tone piece data obtained by division by the division step to be controlled in rearranging the musical tone piece data and also indicative of contents of control thereof, and a generation step of generating new musical tone pattern data by sequentially selecting ones of the plural musical tone piece data which have lengths indicated by the selected rearranging pattern, subjecting ones of the selected musical tone piece data which are located at positions indicated by the selected ratio pattern, to control having contents indicated by the selected ratio pattern, and then rearranging the controlled musical tone piece data.

According to the second aspect, there can be provided as many rearranging manners as combinations of the rearranging patterns and the ratio patterns, and it is possible to freely change positions indicated by a rearranging pattern for musical tone piece data to be controlled and the contents of control, depending on a ratio pattern.

According to a third aspect of the present invention, there is provided a remix apparatus comprising a division device that divides musical tone data having a predetermined length into a plurality of musical tone piece data each having a length smaller than the predetermined length, and a generation device that operates based on a rearranging pattern indicative of a rule for use in rearranging musical tone piece data obtained by division by the division device, to generate new musical tone data by sequentially rearranging musical tone piece data selected from the plurality of musical tone piece data or muting piece data indicative of sections each having an equal length to that of a corresponding one of the selected musical tone piece data.

Further, according to the third aspect, there is also provided a remix method comprising a division step of dividing musical tone data having a predetermined length into a plurality of musical tone piece data each having a length smaller than the predetermined length, and a generation step of operating based on a rearranging pattern indicative of a rule for use in rearranging musical tone piece data obtained by division by the division step, to generate new musical tone data by sequentially rearranging musical tone piece data selected from the plurality of musical tone piece data or muting piece data indicative of sections each having an equal length to that of a corresponding one of the selected musical tone piece data.

According to the third aspect, new musical tone pattern data including muting sections can be generated while maintaining the tempo and groove of the original musical tone pattern data.

According to a fourth aspect of the present invention, there is provided a remix apparatus comprising a division device that divides musical tone data having a predetermined length into a plurality of musical tone piece data each having a length smaller than the predetermined length, and a generation device that operates based on a rearranging pattern indicative of a rule for use in rearranging musical tone piece data obtained by division by the division device, to generate new musical tone pattern data by sequentially rearranging musical tone piece data selected from the plurality of musical tone piece data or modified musical tone piece data generated by sampling and holding a predetermined number of samples of the selected musical tone piece data at a time.

Further, according to a fourth aspect, there is provided a remix method comprising a division step of dividing musical tone data having a predetermined length into a plurality of musical tone piece data each having a length smaller than the predetermined length, and a generation step of operating based on a rearranging pattern indicative of a rule for use in rearranging musical tone piece data obtained by division by the division step, to generate new musical tone pattern data by sequentially rearranging musical tone piece data selected from the plurality of musical tone piece data or modified musical tone piece data generated by sampling and holding a predetermined number of samples of the selected musical tone piece data at a time.

Thus, according to the fourth aspect, new musical tone pattern data including sections with fidelity reduced can be generated while maintaining the tempo and groove of the original musical tone pattern data.

According to a fifth aspect of the present invention, there is provided a remix apparatus comprising a division device that divides musical tone data having a predetermined length into a plurality of musical tone piece data each having a length smaller than the predetermined length, and a generation device that operates based on a rearranging pattern indicative of a rule for use in rearranging musical tone piece data obtained by division by the division device, to generate new musical tone pattern data by sequentially rearranging musical tone piece data selected from the plurality of musical tone piece data or modified musical tone piece data generated by reducing length of sound-generating time of the selected musical tone piece data.

Further, according to the fifth aspect, there is provided a remix method comprising a division step of dividing musical tone data having a predetermined length into a plurality of musical tone piece data each having a length smaller than the predetermined length, and a generation step of operating based on a rearranging pattern indicative of a rule for use in rearranging musical tone piece data obtained by division by the division step, to generate new musical tone pattern data by sequentially rearranging musical tone piece data selected from the plurality of musical tone piece data or modified musical tone piece data generated by reducing length of sound-generating time of the selected musical tone piece data.

According to the fifth aspect, new musical tone pattern data including data length-reduced sections can be generated while maintaining the tempo and groove of the original musical tone pattern data.

According to a sixth aspect of the present invention, there is provided a remix apparatus comprising a selection device that selects first or second musical tone pattern data from a plurality of musical tone pattern data, a division device that divides the selected first musical tone pattern data into a plurality of first musical tone piece data each having a data length smaller than that of the first musical tone pattern data and divides the selected second musical tone pattern data into a plurality of second musical tone piece data each having a data length smaller than that of the second musical tone pattern data, a random number generation device that generates a random number, a first generation device that operates based on a rearranging pattern indicative of a rule for use in rearranging first musical tone piece data obtained by division by the division device and on the generated random number, to rearrange first musical tone piece data selected from the plurality of first musical tone piece data to generate a new third musical tone pattern data, and a second generation device that operates based on the rearranging pattern and the random number used to generate the third musical tone pattern data, to rearrange second musical tone piece data selected from the plurality of second musical tone piece data to generate a new fourth musical tone pattern data.

According to the sixth aspect, there is also a remix method comprising a selection step of selecting first or second musical tone pattern data from a plurality of musical tone pattern data, a division step of dividing the selected first musical tone pattern data into a plurality of first musical tone piece data each having a data length smaller than that of the first musical tone pattern data and divides the selected second musical tone pattern data into a plurality of second musical tone piece data each having a data length smaller than that of the second musical tone pattern data, a random number generation step of generating a random number, a first generation step of operating based on a rearranging pattern indicative of a rule for use in rearranging first musical tone piece data obtained by division by the division step and on the generated random number, to rearrange first musical tone piece data selected from the plurality of first musical tone piece data to generate a new third musical tone pattern data, and a second generation step of operating based on the rearranging pattern and the random number used to generate the third musical tone pattern data, to rearrange second musical tone piece data selected from the plurality of second musical tone piece data to generate a new fourth musical tone pattern data.

According to the sixth aspect, the manner of rearranging the first musical tone pattern data to generate the third musical tone pattern can be used to generate the fourth musical tone pattern data, which is different from the second musical tone pattern data.

According to the seventh aspect of the present invention, there is provided a remix apparatus comprising a selection device that selects one of a plurality of musical tone pattern data, a division device that divides the selected musical tone pattern data into a plurality of musical tone piece data each having a data length smaller than that of the selected musical tone pattern data, a random number generation device that generates a random number, a generation device that operates based on a rearranging pattern indicative of a rule for use in rearranging musical tone piece data obtained by division by the division device and on the generated random number, to rearrange musical tone piece data selected from the plurality of musical tone piece data to generate a new musical tone pattern data, and a storage device that stores rule data indicative of the rearranging pattern and the random number used to generate the new musical tone pattern data.

According to the seventh aspect, there is also provided a remix method comprising a selection step of selecting one of a plurality of musical tone pattern data, a division step of dividing the selected musical tone pattern data into a plurality of musical tone piece data each having a data length smaller than that of the selected musical tone pattern data, a random number generation step of generating a random number, a generation step of operating based on a rearranging pattern indicative of a rule for use in rearranging musical tone piece data obtained by division by the division step and on the generated random number, to rearrange musical tone piece data selected from the plurality of musical tone piece data to generate a new musical tone pattern data, and a storage step of storing rule data indicative of the rearranging pattern and the random number used to generate the new musical tone pattern data.

According to the seventh aspect, the manner of rearrangement (the rearranging pattern and the random number) used to rearrange musical tone pattern data can be saved as rule data. Using the rule data, new musical tone pattern data can be generated by rearranging other musical tone pattern data in the same manner as the above rearrangement.

The above and other objects, features, and advantages of the invention will become more apparent from the following detailed description taken in conjunction with the accompanying drawings.

BRIEF DESCRIPTION OF THE DRAWINGS

FIG. 4 is a diagram showing an example of a rearranging pattern table in FIG. 3;

FIG. 6 is a diagram showing an example of a ratio pattern table in FIG. 3;

FIG. 7A is a diagram showing an example of a manner of reducing the length of musical tone piece data;

FIG. 7B is a diagram showing an example of a manner of changing the attenuation speed of musical tone piece data;

FIG. 7C is a diagram showing an example of a manner of changing the attenuation position of musical tone piece data;

FIG. 7D is a diagram showing an example of a manner of changing the attenuation curve of musical tone piece data;

DETAILED DESCRIPTION OF THE PREFERRED EMBODIMENT

The present invention will be described in detail by way of example with reference to the drawings showing a preferred embodiment thereof.

Figure 1:
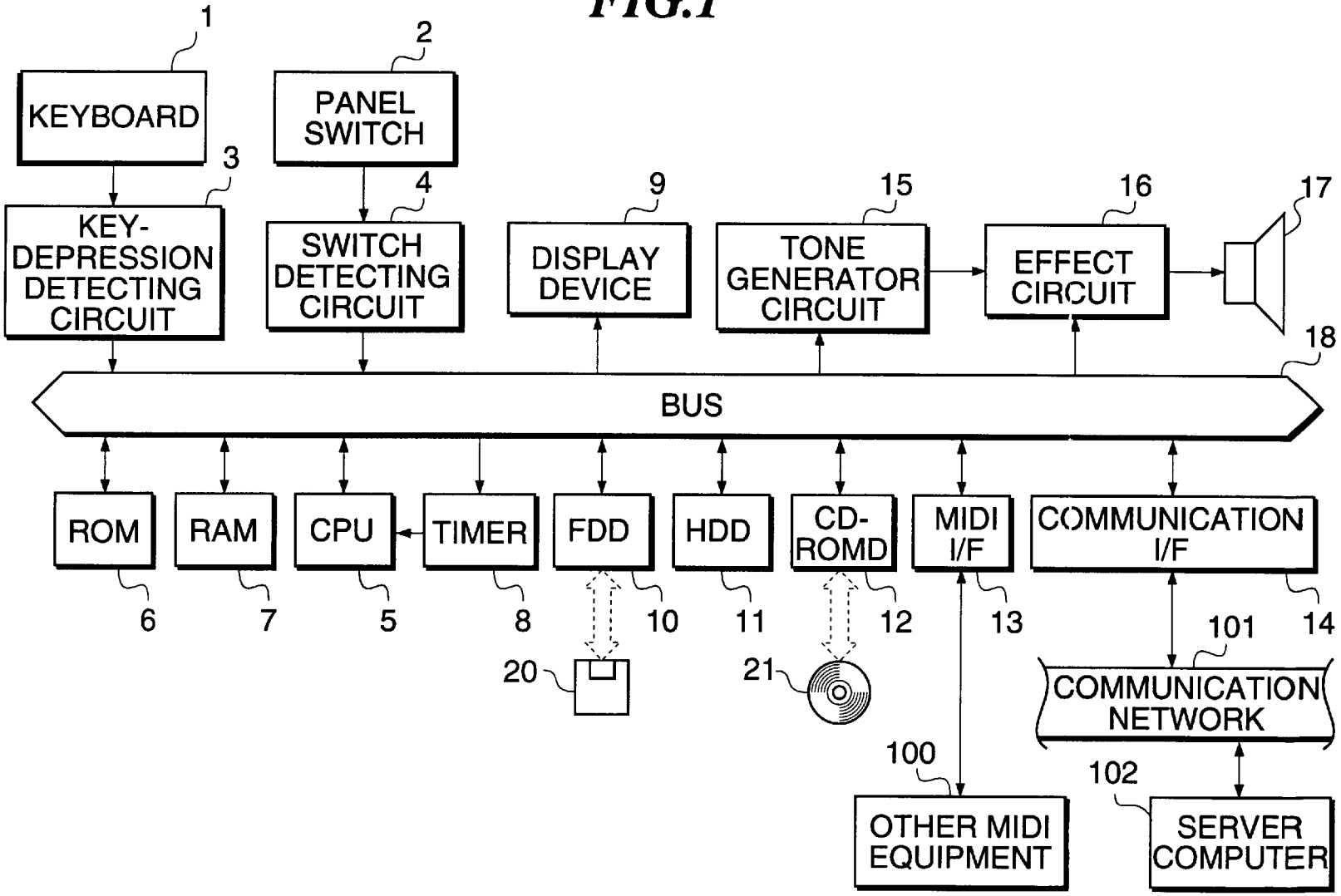
FIG. 1 is a block diagram schematically showing the construction of a remix apparatus according to an embodiment of the present invention.

FIG. 1 is a block diagram schematically showing the construction of a remix apparatus according to an embodiment of the present invention. As shown in FIG. 1, the remix apparatus of the present embodiment is comprised of a keyboard 1 for inputting information about pitch, a switch group 2 composed of a plurality of switches for inputting various kinds of information, a key depression detecting circuit 3 for detecting a depressed state of each key of the keyboard 1, a switch detecting circuit 4 for detecting a depressed state of each switch of the switch group 2, a CPU 5 for controlling the entire apparatus, a ROM 6 that stores control programs executed by the CPU 5 and a variety of table data and the like, a RAM 7 for temporarily storing performance data, various kinds of information, results of operations, and the like, a timer 8 for measuring a timer interrupting time in a timer interrupting process and other times, and a display device 9 provided with, e.g. a large-sized liquid crystal display (LCD) or a cathode ray tube (CRT) display and light emitting diodes (LEDs) and the like for displaying various kinds of information. The remix apparatus is further comprised of a floppy disk drive (FDD) 10 for driving a floppy disk (FD) 20 as a storage medium, a hard disk drive (HDD) 11 for driving a hard disk (not illustrated) which stores a variety of application programs including control programs, a variety of data, and the like, a CD-ROM drive (CD-ROMD) 12 for driving a compact disk read only memory (CD-ROM) which stores a variety of application programs including control programs, a variety of data, and the like, a MIDI interface (I/F) 13 for receiving musical instrument digital interface (MIDI) signals from the outside and outputting MIDI signals to the outside, a communication interface (I/F) 14 for transmitting and receiving data to and from, e.g. a server computer 102 on a communication network, a tone generator circuit 15 for converting performance data inputted from the keyboard 1 and predetermined performance data into musical tone signals, an effect circuit 16 for adding a variety of effects to the musical tone signals transmitted from the tone generator circuit 15, and a sound system 17 composed of a digital-to-analog converter (DAC), an amplifier and a speaker for converting the musical tone signals from the effect circuit 16 into sounds. The above-mentioned components 3–16 are connected with each other through a bus 18. The timer 8 is connected to the CPU 5, other MIDI equipment 100 is connected to the MIDI I/F 13, the communication network 101 is connected to the communication I/F 14, the effect circuit 16 is connected to the tone generator circuit 15, and the sound system 17 is connected to the effect circuit 16.

As stated above, the control programs executed by the CPU 5 can be stored in the hard disk of the HDD 11. In the case where a certain control program is not stored in the ROM 6, the control program can be stored in the hard disk, so that the control program can be read into the RAM 7 and the CPU 5 can operate in the same manner as in the case where the control program is stored in the ROM 6. This facilitates the addition of new control programs or upgrades to a version of an existing program. The control programs and the variety of data are read from the CD-ROM 21 of the CD-ROM drive 12 and are store dint he hard disk of the HDD 11. This facilitates the installment of additional control programs and upgrading a version of an existing program. An external storage device other than the CD-ROM drive 12 may be provided in order to use various kinds of media such as magneto optical disk (MO).

As stated above, the communication I/F 14 is connected to the communication network 101 such as a local area network (LAN), the Internet, and a telephone line. The communication I/F 14 can connect to the server computer 102 via the communication network. In the case where a certain program or parameters are not stored in the hard disk of the HDD 11, the communication I/F 14 is used to download the program or the parameters from the server computer 102. A client computer (the remix apparatus in the present embodiment) transmits a command to the server computer 102 via the communication network 101 to request downloading of the program or the parameters. In response to the command, the server computer 102 transmits the requested program or the parameters to the client computer. The client computer receives the program or the parameters through the communication I/F 14 and stores them in the hard disk of the HDD 11 to complete the downloading. The remix apparatus may also be provided with an interface for transmitting and receiving data directly to and from an external computer or the like.

Figure 2:
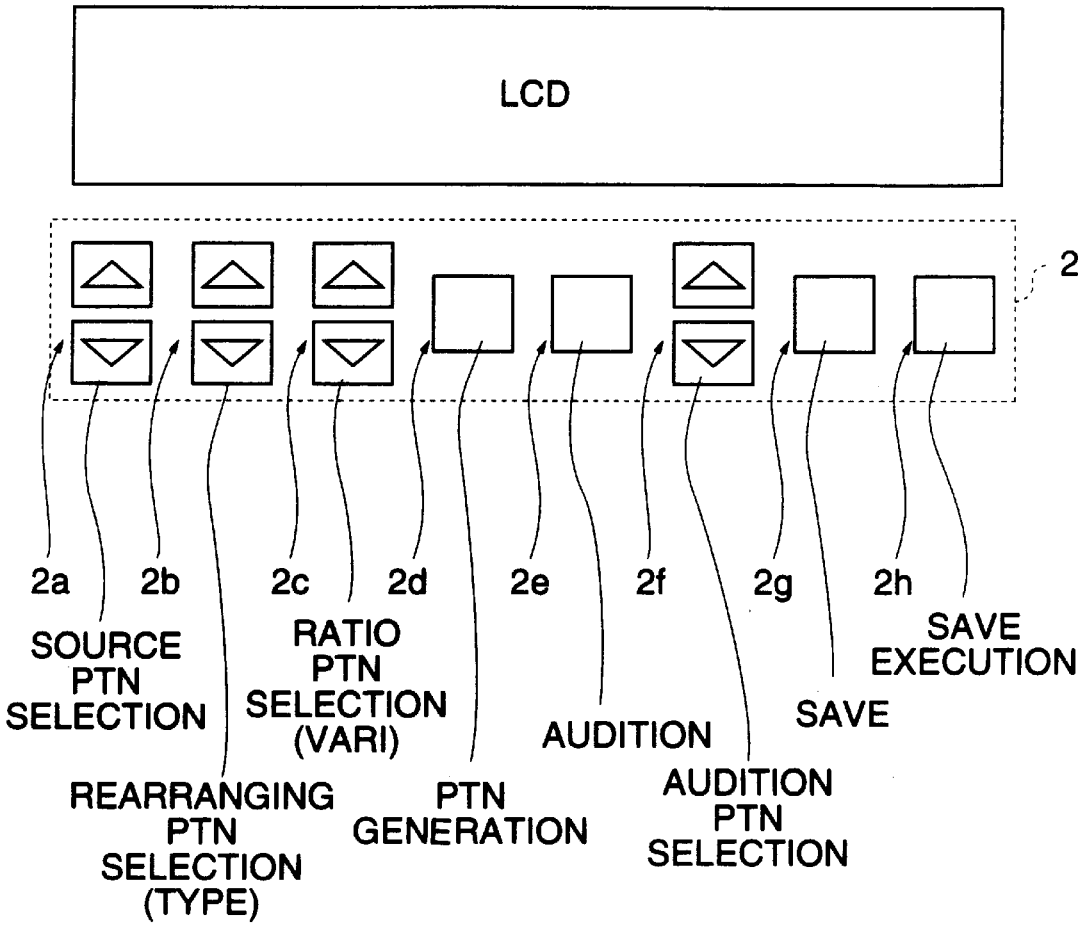
FIG. 2 is a view showing an example of the configuration of an operation panel of the remix apparatus in FIG. 1.

FIG. 2 shows an example of the configuration of an operation panel of the remix apparatus according to the present invention. The operation panel is comprised of the panel switch 2 and the display device (formed of a LCD in the present embodiment) 9.

As shown in FIG. 2, the panel switch 2 is comprised of an up/down switch (hereinafter referred to as "the source PTN selecting switch") 2*a* for selecting one of various original musical tone patterns (PTN) displayed on the display device 9, that is, musical tone patterns used as sources for generating new musical tone patterns, an up/down switch (hereinafter referred to as "the rearranging PTN selecting switch") for selecting one of various rearranging patterns (PTN) displayed on the display device, that is, patterns each representing a rule for rearranging a plurality of musical tone piece data constituting an original or source pattern, or a variety of user rules, that is, manners in which audition patterns, referred to later, are generated from source patterns (specifically, the manners each include the pattern number and random number value used), an up/down switch (hereinafter referred to as "the ratio PTN selecting switch") 2*c* for selecting one of various ratio patterns displayed on the display device 9, that is, patterns each representing a control manner in which the musical tone piece data are rearranged (this manner will be hereinafter referred to as "the rearranging manner"), a pattern (PTN) generating switch (hereinafter referred to as "the PTN generating switch") 2*d* for generating a new musical tone pattern based on the source pattern, rearranging pattern (or user rule), and ratio pattern selected by the switches 2*a* to 2*c*, an audition switch 2*e* for reproducing the new musical tone pattern generated by the PTN generating switch 2*d*, for audition, and an up/down switch (hereinafter referred to as "the audition PTN selecting switch") 2*f* for selecting one of various musical tone patterns displayed on the display device 9, that is, one of the newly generated musical tone patterns which is to be auditioned, a save switch 2*g* for shifting the apparatus into a save mode for saving one of the newly generated various musical tone patterns which is desired to be saved or its generation manner (data stored as a user rule) in a predetermined area of the RAM 7 (a pattern or table area, which will be referred to later), and a save execution switch 2*h* for commanding a saving destination set in the save mode to save a simultaneously set saving object (the musical tone pattern or its generation manner). Although the panel switch 2 includes various other switches, for example, a power switch, these switches are not characteristic of the present invention and illustration and description thereof are omitted.

Control processing executed by the remix apparatus constructed as above will be described with reference to FIGS. 3 to 17.

Figure 3:
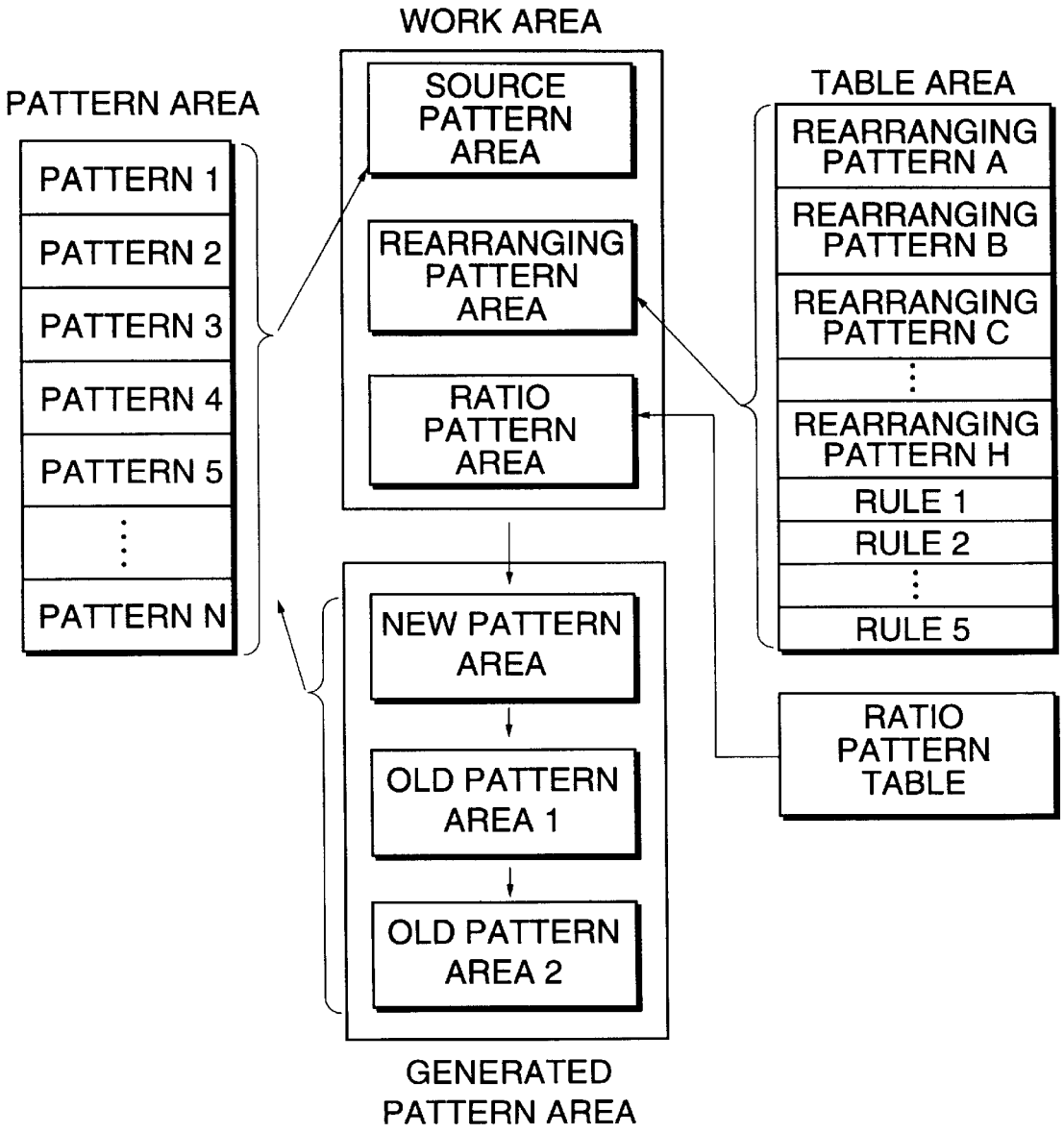
FIG. 3 is a diagram visually representing control processing executed by the remix apparatus in FIG. 1.
Figure 9:
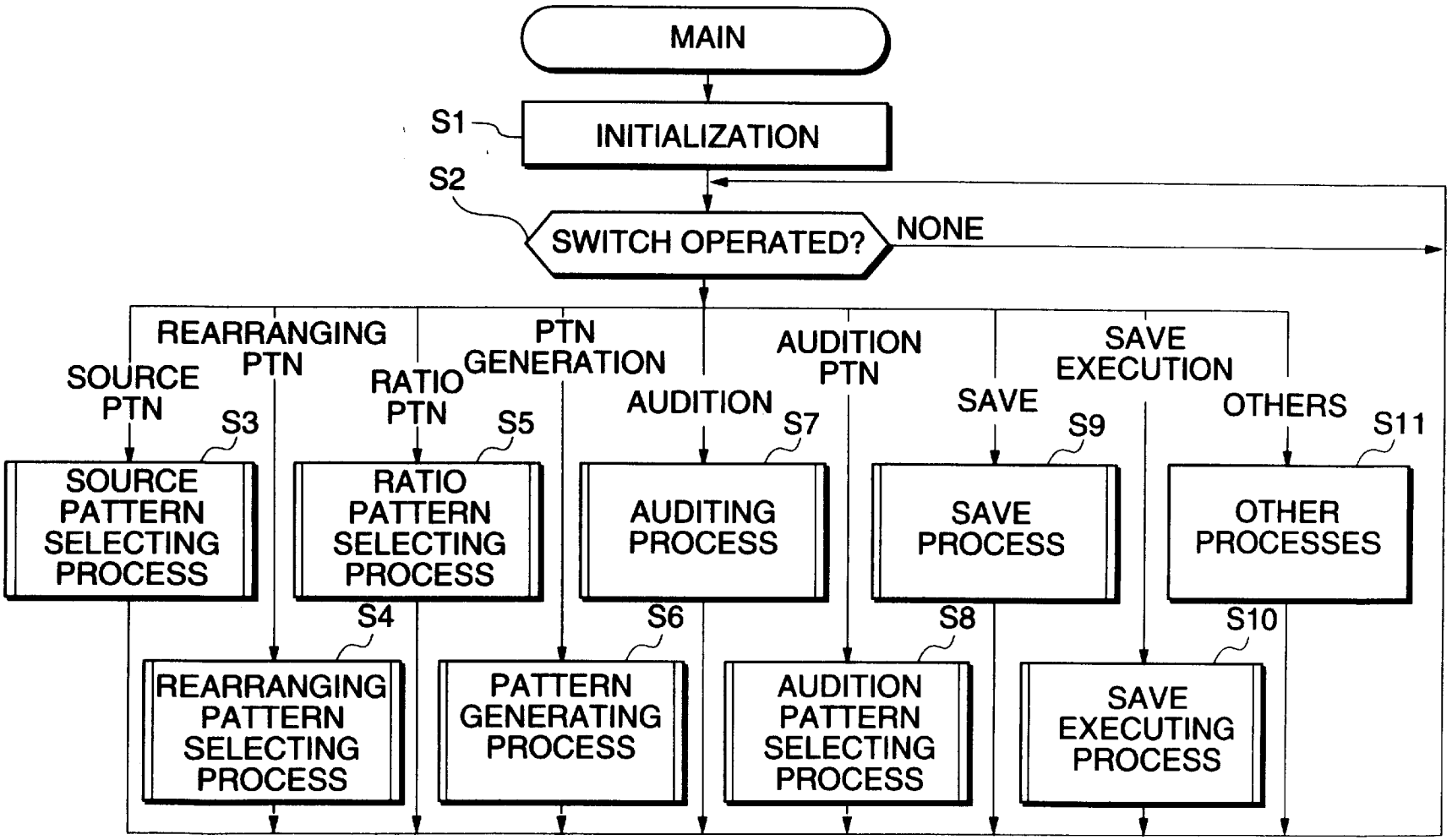
FIG. 9 is a flow chart showing a main routine executed by a CPU in FIG. 1.

FIG. 3 schematically visually represents the control processing executed by the remix apparatus according to the present embodiment, and FIG. 9 is a flow chart showing a main routine for realizing this control processing, that is, a main routine executed by the CPU 5. This main routine is started when a user depresses, for example, the power switch, not shown.

In FIG. 9, first, an initializing process is executed to clear a work area (see FIG. 3) of the RAM 7, set an initial tempo, and copy basic (default) source patterns, rearranging patterns, and ratio patterns into a source pattern area, a rearranging pattern area, and a ratio pattern area in the work area, respectively (step S1).

Next, it is determined whether or not the user has operated any switch of the panel switch 2, and when the user has not operated any switch, the process stands by until a switch operation is performed. On the other hand, when the user has operated a switch, the process proceeds to a process corresponding to the operated switch (step S2). The present embodiment executes the following eight types of processes corresponding, respectively, to the above eight types of switches 2*a* to 2*h:*

1) a source pattern selecting process executed when the source PTN selecting switch 2*a* is operated (step S3);
2) a rearranging pattern selecting process executed when the rearranging PTN selecting switch 2*b* is operated (step S4);
3) a ratio pattern selecting process executed when the ratio PTN selecting switch 2*c* is operated (step S5);
4) a pattern generating process executed when the PTN generating switch 2*d* is operated;
5) an audition switch executed when the audition switch 2*e* is operated (step S7);
6) an audition pattern selecting process executed when the audition PTN selecting switch 2*f* is operated (step S8);
7) a save process executed when the save switch 2*g* is operated (step S9); and
8) a save executing process executed when the save execution switch 2*h* is operated (step S10).

Further, when switches other than the ones shown above are operated, processes depending on these switches (other processes) are executed (step S11).

The processes 1) to 8) will be individually described below in detail.

1) The source pattern selecting process comprises copying into the source pattern area, one musical tone pattern selected by the user by operating the source PTN selecting switch 2*a*, from a plurality of musical tone patterns (in the illustrated example, N musical tone patterns labeled 1 to N) stored in a pattern area in FIG. 3 and displayed on the display device 9. The pattern area is provided in the RAM 7 at a predetermined location, and in which are stored previously created various musical tone patterns (that is, source patterns) and new musical tone patterns generated by a method described later.

Figure 10:
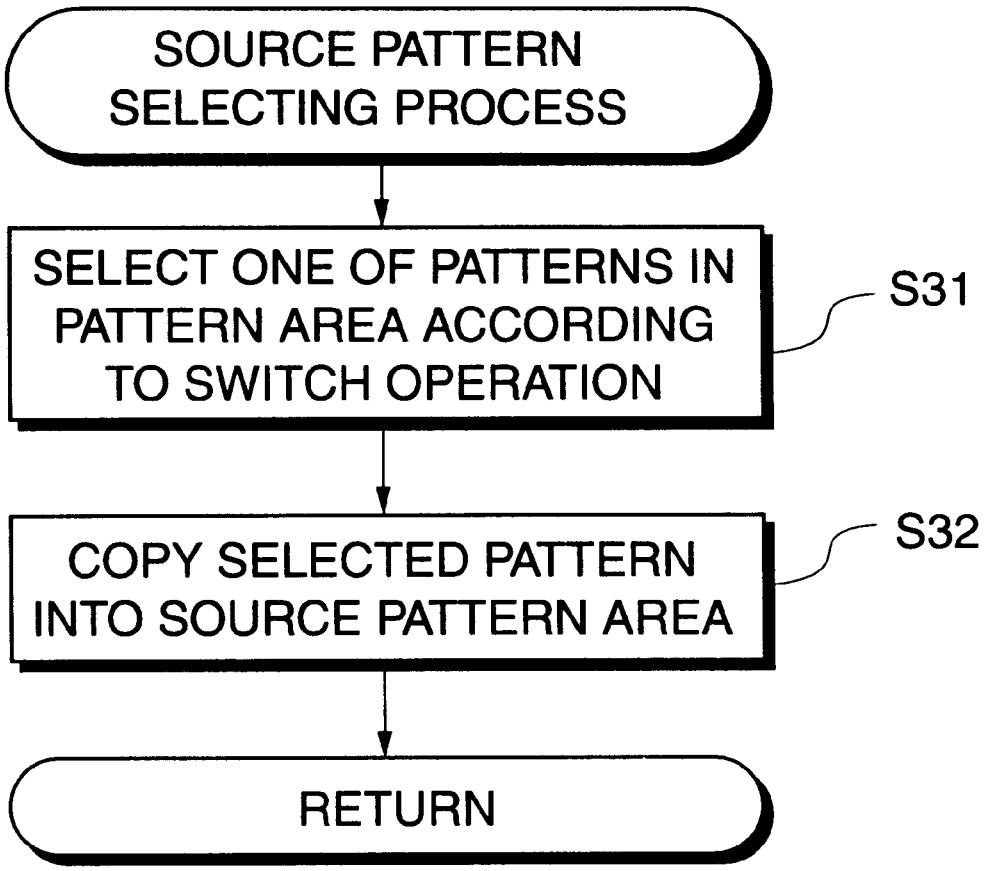
FIG. 10 is a flow chart showing details of a source pattern selecting process in FIG. 9.

FIG. 10 is a flow chart showing details of the source pattern selecting process. First, when the user operates the source PTN selecting switch 2*a*, one of the patterns within the pattern area is selected according to this switch operation (step S31), and then the selected pattern is copied into the source pattern area (step S32).

2) The rearranging pattern selecting process is performed such that if the user operates the rearranging PTN selecting switch 2*b* to select one rearranging pattern from a plurality of rearranging patterns or user rules stored in a rearranging pattern table and displayed on the display device 9, then the selected rearranging pattern is copied into the rearranging pattern area, and if the user selects one user rule, then rearranging and ratio patterns specified by this user rule are copied into the rearranging and ratio pattern areas, respectively.

The rearranging pattern table is comprised of a plurality of the rearranging patterns (in the present embodiment, eight patterns labeled A to H) for rearranging a plurality of musical tone piece data constituting the selected source pattern, that is, the source pattern copied into the source pattern area, as well as a plurality of the user rules (in the present embodiment, five rules labeled 1 to 5). The rearranging pattern table is stored in a table area, which is provided in the RAM 7 at a predetermined location.

FIG. 4 shows an example of the rearranging pattern table. The rearranging pattern table is comprised of a plurality of (in the illustrated example, eight, as stated above) rearranging pattern data.

In FIG. 4, for example, the pattern H is comprised of four types of numerical value date ("2", "1", "0.5", and "0.25"). In the present embodiment, each source pattern is comprised of a musical tone pattern for one bar (for example, waveform data obtained by sampling sounds generated by a player actually using a musical instrument, musical tone waveform data cut out from a music CD or the like, or a sequence of MIDI data such as a rhythm pattern), and four types of musical tone piece data having different data lengths are generated based on this musical tone pattern for one bar.

Figure 5:
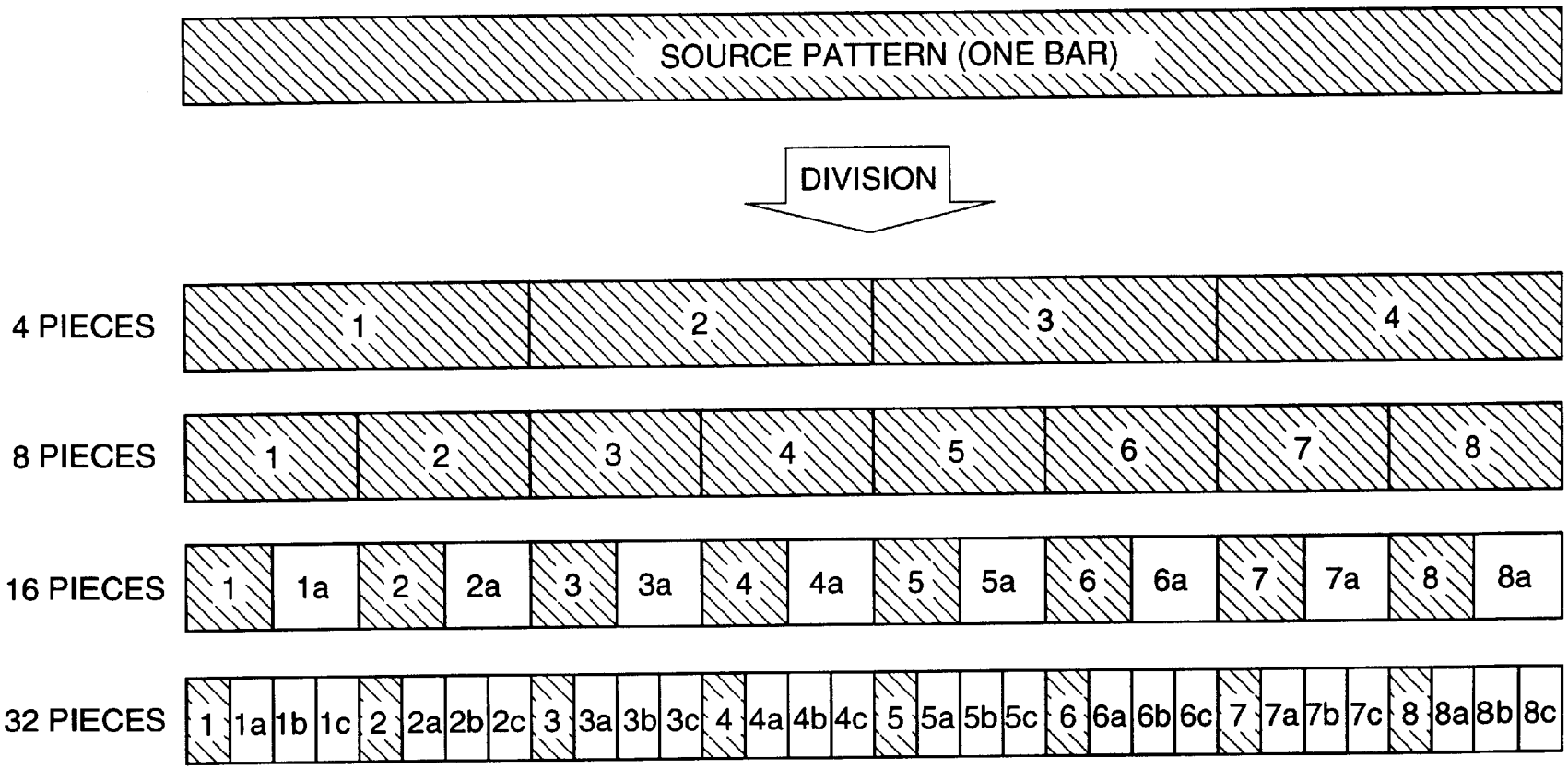
FIG. 5 is a diagram useful in explaining a manner of generating four types of musical tone piece data.

FIG. 5 shows a manner of generating these four types of musical tone piece data. As shown in FIG. 5, the musical tone pattern for one bar is evenly divided into 4, 8, 16, and 32 pieces to generate musical tone piece data composed of quarter, eighth, sixteenth, and thirty-second note lengths, respectively. The quarter, eighth, sixteenth, and thirty-second note lengths correspond to the above numerical value date "2", "1", "0.5", and "0.25", respectively. In this figure, the shaded musical tone piece data are used when "random (default)" is set as a rearranging manner (its meaning and contents will be described later). That is, all of the musical tone piece data of the divided source pattern are rearranged at positions indicated by the numerical value date "2" or "1", while part of the musical tone piece data of the divided source pattern (for the source pattern divided into 16 pieces, odd-number-th musical tone piece data, and for the source pattern divided into 32 pieces, n-th musical tone piece data meeting $n \equiv 1 \pmod 4$) are rearranged at positions indicated by the numerical value date "0.5" or "0.25". The reason why the musical tone piece data rearranged at the positions indicated by the numerical value date "0.5" or "0.25" are limited to part of the divided source pattern is that this part often contains effective sounds. Of course, the rearranging unit is not limited to the above four types but may be any value such as "1.5", as shown in a pattern F. In the present embodiment, however, numerical values are determined such that the sum of the numerical values of each rearranging pattern is equal to "8", which is the data length of the source pattern, that is, one bar length.

In the present embodiment, the source pattern is automatically evenly divided by the CPU 5, and data indicative of the boundary of each musical tone piece data is embedded in the source pattern. The present invention is, however, not limited to this. Alternatively, the data indicative of the boundary of each musical tone piece data may be embedded in the source pattern at the time of generating the source pattern. Further, alternatively to embedding the boundary data in the source pattern, addresses of the musical tone pattern corresponding to the boundary positions may be managed separately from the source pattern.

For example, the address region at which the musical tone pattern is stored may be evenly divided between its leading and final addresses in the memory so that the address of each divided point can be managed as a divided position, and the address management method may use absolute addresses or addresses relative to the leading address. The expression "dividing the source pattern" also includes "setting positional information (for example, addresses)" indicating the positions of data in the source pattern which are to be selected for rearranging instead of actual division of the source pattern into a plurality of pieces.

In addition, the present invention is not limited to the even division of the source pattern into a plurality of musical tone pieces, but the source pattern may be unevenly divided. For example, peak positions of a waveform from the source pattern may be automatically detected and determined as divided points, or the user may arbitrarily set divided positions. Further, evenly divided points may be set or peak positions may be automatically determined as divided points, and then the user may then finely adjust the divided points. The fine adjustment of the divided points may be carried out by providing a plurality of fine adjustment operators, not shown, corresponding, respectively, to divided points and operating these fine adjustment operators to finely adjust the divided points so as to prevent occurrence of click noise if such noise occurs when the rearranging pattern is auditioned during the auditing process, which will be described later.

Further, the numerical value data of each rearranging pattern have their rearranging manner changed by the ratio pattern, described later. The present embodiment has six types of rearranging manners including "fixed" and "random". The "fixed" refers to fixation with respect to the source pattern, that is, the musical tone piece data are not rearranged, and the "random" refers to randomness with respect to the source pattern, that is, the musical tone piece data are randomly selected from other musical tone piece data. In the present embodiment, the random is a reference (default) rearranging manner. The other rearranging manners will be described in the description of the 3) ratio pattern selecting process.

In FIG. 4, the shaded numerical value data indicate that the rearranging manner has been changed to the "fixed".

In the present embodiment, rearranging patterns have been previously created and stored within the table area of the RAM 7 (for example, the contents stored in the RAM 7 are held by a backup power supply), but the present invention is not limited to this. The user may create rearranging patterns.

Figure 11:
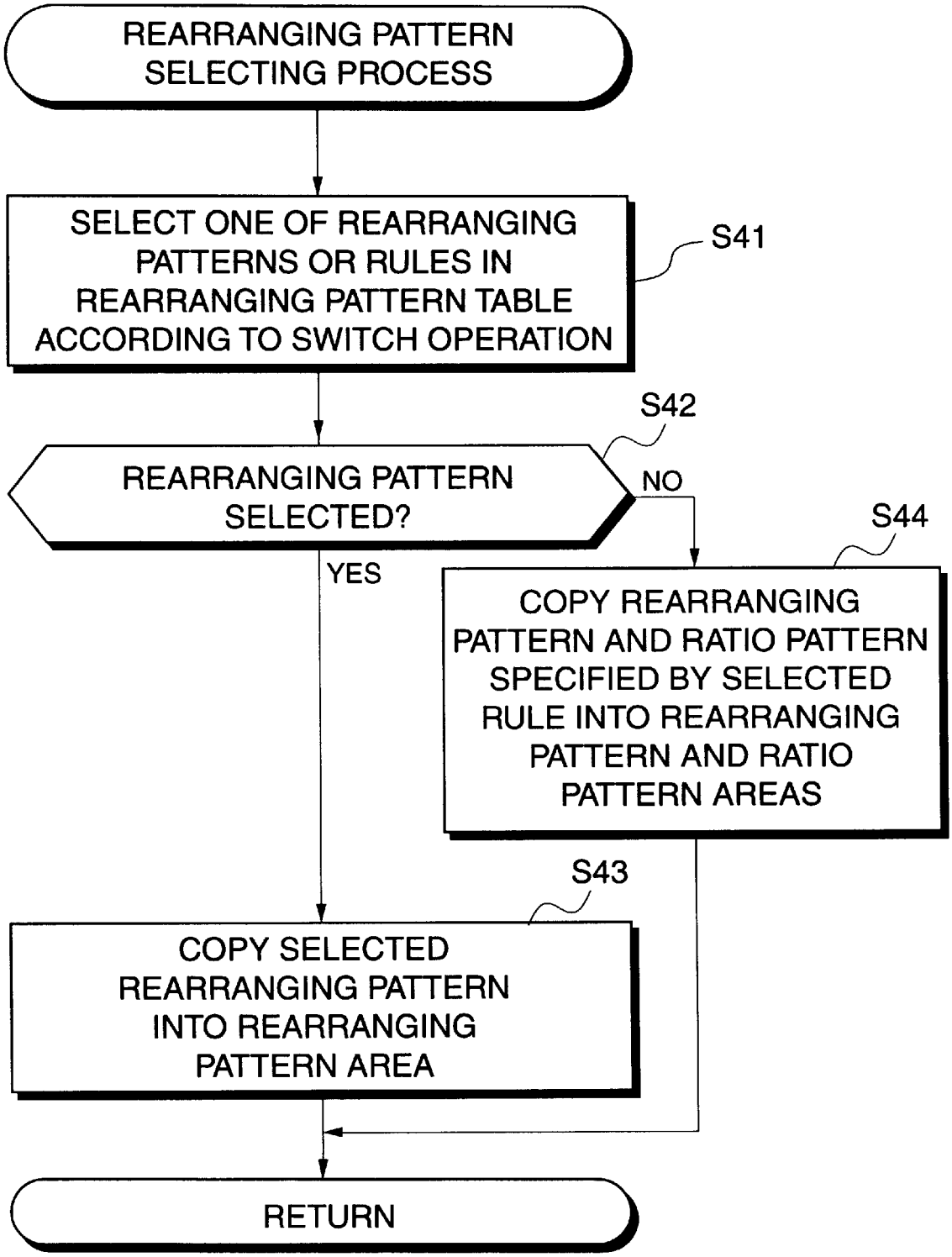
FIG. 11 is a flow chart showing details of a rearranging pattern selecting process in FIG. 9.

FIG. 11 is a flow chart showing details of the rearranging pattern selecting process. First, when the user operates the rearranging PTN selecting switch 2*b*, one of the rearranging patterns or user rules in the rearranging pattern table is selected according to the switch operation (step S41).

Next, it is determined whether or not a rearranging pattern has been selected (step S42), and when a rearranging pattern has been selected, it is copied into the rearranging pattern area (step S43). On the other hand, when a user rule has been selected, a rearranging pattern and a ratio pattern specified by this user rule are copied into the rearranging and ratio pattern areas, respectively (step S44). The selection of the rearranging pattern determines particulars of a new pattern to be generated (where long musical tone piece data is to be rearranged, and others), and the selection of the user rule enables the reproduction of a rearranging pattern and a ratio pattern used in the past by the user when creating an audible pattern.

3) The ratio pattern selecting process comprises copying into the ratio pattern area, one of plural ratio patterns stored in the ratio pattern table which is selected by the user by operating the PTN selecting switch 2*c*.

The ratio pattern table is comprised of plural types of ratio patterns for determining a rearranging manner ("mute", "fixed", "LoFi", "pitch change", and "data length reduction") for the selected rearranging pattern, that is, the rearranging pattern copied into the rearranging pattern area. The ratio pattern table is previously stored in a table area, which is provided in the ROM 6 at a predetermined location.

FIG. 6 shows an example of the ratio pattern table, which is comprised of a plurality of ratio pattern data (in the illustrated example, 10 ratios labeled A to J).

As shown in FIG. 6, each ratio pattern data is comprised of plural sets of data wherein a pair of data in parenthesis constitute one set of data. Each set of data in parenthesis are comprised of two integral values, and the left-hand numerical value indicates a position in a sequence of numerical values (for example, in the pattern A, 2, 1, 2, 1, 2) constituting a rearranging pattern, while the right-hand numerical value indicates the contents of control executed on musical tone piece data to be rearranged at the position indicated by the left-hand numerical value. The left-hand numerical value ranges up to the maximum value of the number of numerical values belonging to the sequence of numerical values constituting the rearranging pattern, and the right-hand value ranges from 0 to 4. The contents of control corresponding to each integral value are shown below.

0: mute, 1: fixed, 2: LoFi, 3: pitch change, and 4: data length reduction wherein:

1) the "0: mute" means control that allows no sound to be produced without rearranging musical tone piece data,
2) the "1: fixed" means control that uses musical tone piece data at an original position thereof as they are, without rearranging other musical tone piece data at the original position,
3) the "2: LoFi" means control that reduces the fidelity of randomly (default) selected musical tone piece data,
4) the "3: pitch change" means control that changes the pitch of randomly (default) selected musical tone piece data, and
5) the "4: data length reduction" means control that reduces the data length of randomly (default) selected musical tone piece data.

The fidelity reduction in 3) is performed specifically by sampling and holding a predetermined number of samples of musical tone piece data at a time for each sample if the musical tone piece data are waveform data. If, for example, samples of the original waveform data are: SD(0), SD(1), SD(2), SD(3), SD(4), SD(5), SD(6), SD(7), SD(8), SD(9), then these samples can have their fidelity reduced by sampling and holding them as follows: SD(0), SD(0), SD(2), SD(2), SD(4), SD(4), SD(6), SD(6), SD(8), SD(8) . . . .

The pitch change in 4) can be carried out specifically by holding each sample, for example, for two sampling periods to reduce the pitch to half if the musical tone piece data are waveform data. If, for example, samples of the original waveform data are: SD(0), SD(1), SD(2), SD(3), SD(4), SD(5), SD(6), SD(7), SD(8), SD(9), then the pitch of these samples can be changed by holding them as follows: SD(0), SD(0), SD(1), SD(1), SD(2), SD(2), SD(3), SD(3), SD(4), SD(4) . . . .

In the data length reduction in 5), as shown, for example, in FIG. 7A, the above musical tone piece data have their data length reduced as follows: If the musical tone piece data are waveform data, a volume envelope thereof is attenuated. If the musical tone piece data are automatic performance data, the value of a volume parameter contained in the automatic performance data is gradually reduced.

Instead of the data length reduction, the types of the contents of control may be increased to vary the attenuation speed, position, or curve as shown in FIGS. 7B to 7D. Alternatively, the types of the contents of control may be increased such that arbitrary combinations of the controls 0 to 4 can be selected.

Referring back to FIG. 6, the first set of data in a ratio D is (1, 1), meaning that if, for example, the pattern C (2, 1, 1, 2, 1, 0.5, 0.5) is selected as the rearranging pattern, the first numerical value ("2") of the sequence of numerical values constituting the pattern C is controlled (changed) from the "random", which is a default, to the "fixed".

"null" is set for a ratio A, which means that no control is provided. Thus, the rearranging pattern remains set to the "random", which is a default.

Figure 12:
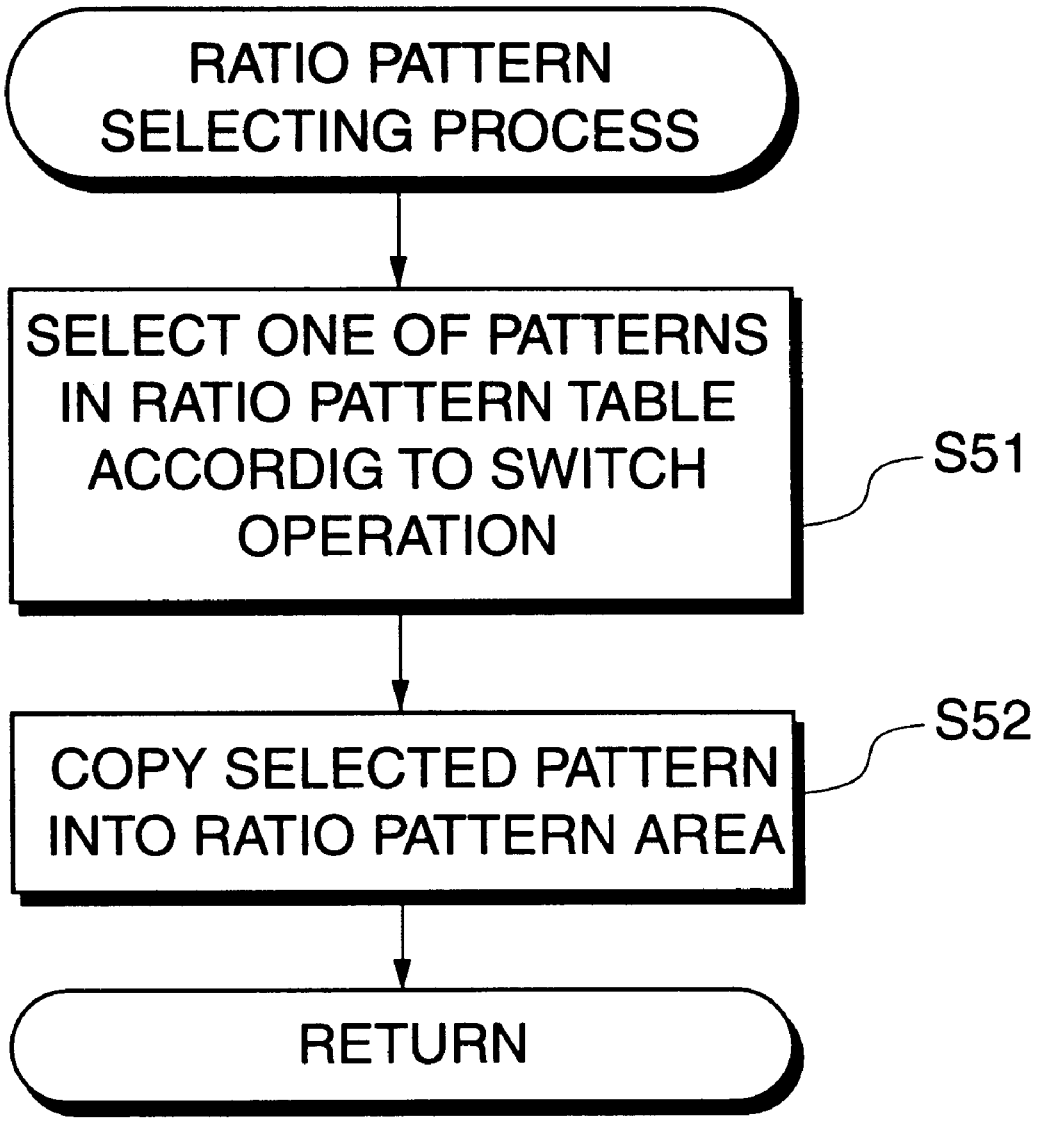
FIG. 12 is a flow chart showing details of a ratio pattern selecting process in FIG. 9.

FIG. 12 is a flow chart showing details of the ratio pattern selecting process. First, when the user operates the ratio PTN selecting switch 2*c*, one of the patterns within the ratio pattern table is selected according to this switch operation (step S51). Then, the selected pattern is copied into the ratio pattern area (step S52).

4) The pattern generating process comprises generating a new musical tone pattern by rearranging each of the musical tone piece data in the source pattern copied into the source pattern area based on the rearranging pattern copied into the rearranging pattern area and the ratio pattern copied into the ratio pattern area.

Figure 8A:
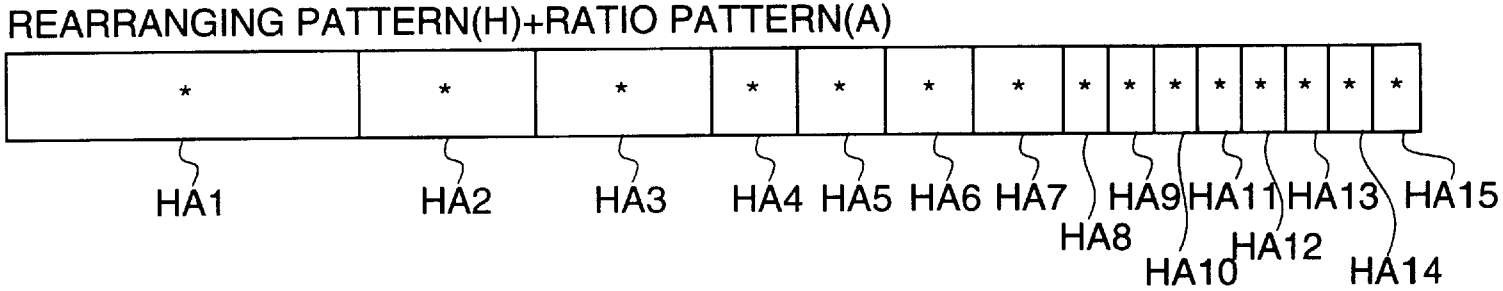
FIGS. 8A to 8C show diagrams each showing an example of a new pattern generated by means of a pattern generating process.
Figure 8B:
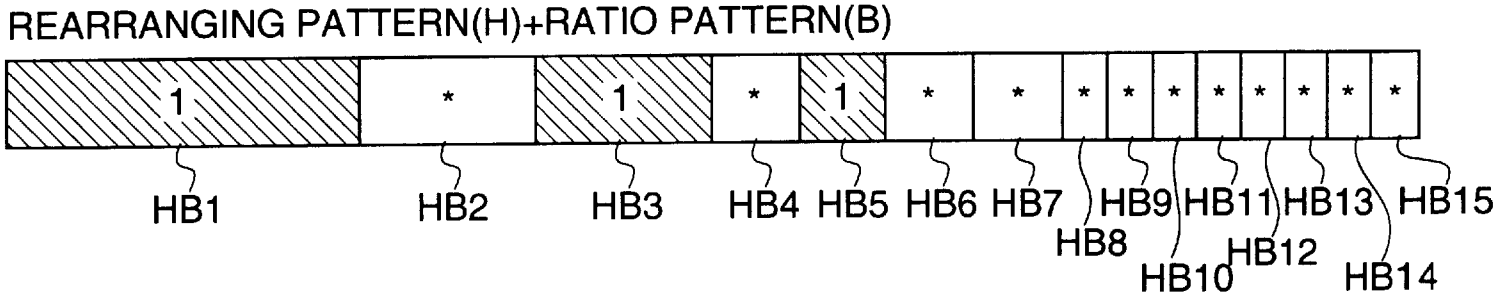
Figure 8C:
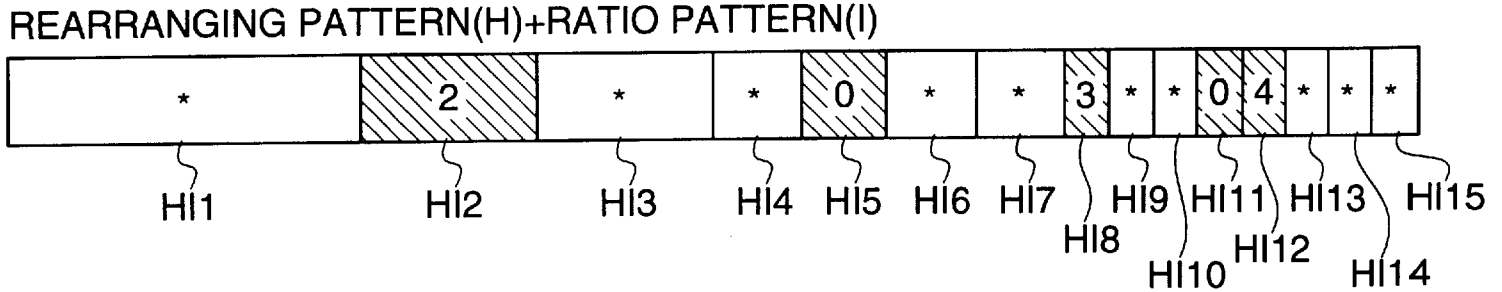

FIGS. 8A to 8C show examples of patterns generated by applying the ratio patterns of the ratios A, B, I in FIG. 6 to the pattern H in FIG. 4 when this pattern is selected as the rearranging pattern.

In FIG. 8A, since the pattern H consists of the sequence of numerical values 2, 1, 1, 0.5, 0.5, 0.5, 0.5, 0.25, 0.25, 0.25, 0.25, 0.25, 0.25, 0.25, 0.25, and the ratio A is "null", musical tone piece data of data lengths each assigned to a corresponding one of rearranging positions HA1–HA15 are randomly rearranged at these rearranging positions. Specifically, any one of the musical tone piece data "1" to "4" shown in FIG. 5 and generated by evenly dividing the source pattern into four pieces is randomly selected and rearranged at the position HA1, two of the musical tone piece data "1" to "8" shown in FIG. 5 and generated by evenly dividing the source pattern into eight pieces are randomly selected and rearranged at the positions HA2 and HA3, four of the musical tone piece data "1" to "8" shown in FIG. 5 and generated by evenly dividing the source pattern into 16 pieces are randomly selected and rearranged at the positions HA4–HA7, and seven of the musical tone piece data "1" to "8" shown in FIG. 5 and generated by evenly dividing the source pattern into 32 pieces are randomly selected and rearranged at the positions HA8–HA14.

In FIG. 8B, since the ratio B is (1, 1), (3, 1), (5, 1), musical tone piece data at positions HB1, HB3, and HB5 are not rearranged, whereas musical tone piece data are selected and rearranged at the other positions as in FIG. 8A.

In addition, in FIG. 8C, since the ratio I is (2, 2), (5, 0), (8, 3), (11, 0), (12, 4), a randomly selected one of the musical tone piece data "1" to "8" generated by evenly dividing the source pattern into eight pieces is rearranged at a position HI2 after having its fidelity reduced, randomly selected two of the musical tone piece data "1" to "8" generated by evenly dividing the source pattern into 32 pieces are rearranged at positions HI5 and HI11 after having been muted, a randomly selected one of the musical tone piece data "1" to "8" generated by evenly dividing the source pattern into 32 pieces is rearranged at a position HI8 after having its pitch changed, and a randomly selected one of the musical tone piece data "1" to "8" generated by evenly dividing the source pattern into 32 pieces is rearranged at a position HI12 after having its data length reduced.

In addition, if, for example, the pattern F in FIG. 4 is selected as the rearranging pattern, and when a section of section length "1.5" is designated, musical tone piece data of length "1.5" from the leading position of a section of length "2" is assigned to the section of length "2".

Although in the present embodiment, overlapping assignment is permitted in the random assignment of musical tone piece data, the overlapping assignment may be inhibited. Furthermore, the user may select either method. Specifically, a mode for permitting the overlapping assignment and a mode for inhibiting the same are provided so that the user can select one of these modes by using, for example, a mode switch, not shown, included in the panel switch 2. When the permission mode is selected, musical tone piece data are randomly assigned as in the present embodiment, whereas when the inhibition mode is selected, the remaining musical tone piece data, that is, all the musical tone piece data other than already assigned ones are selected and assigned.

Figure 13:
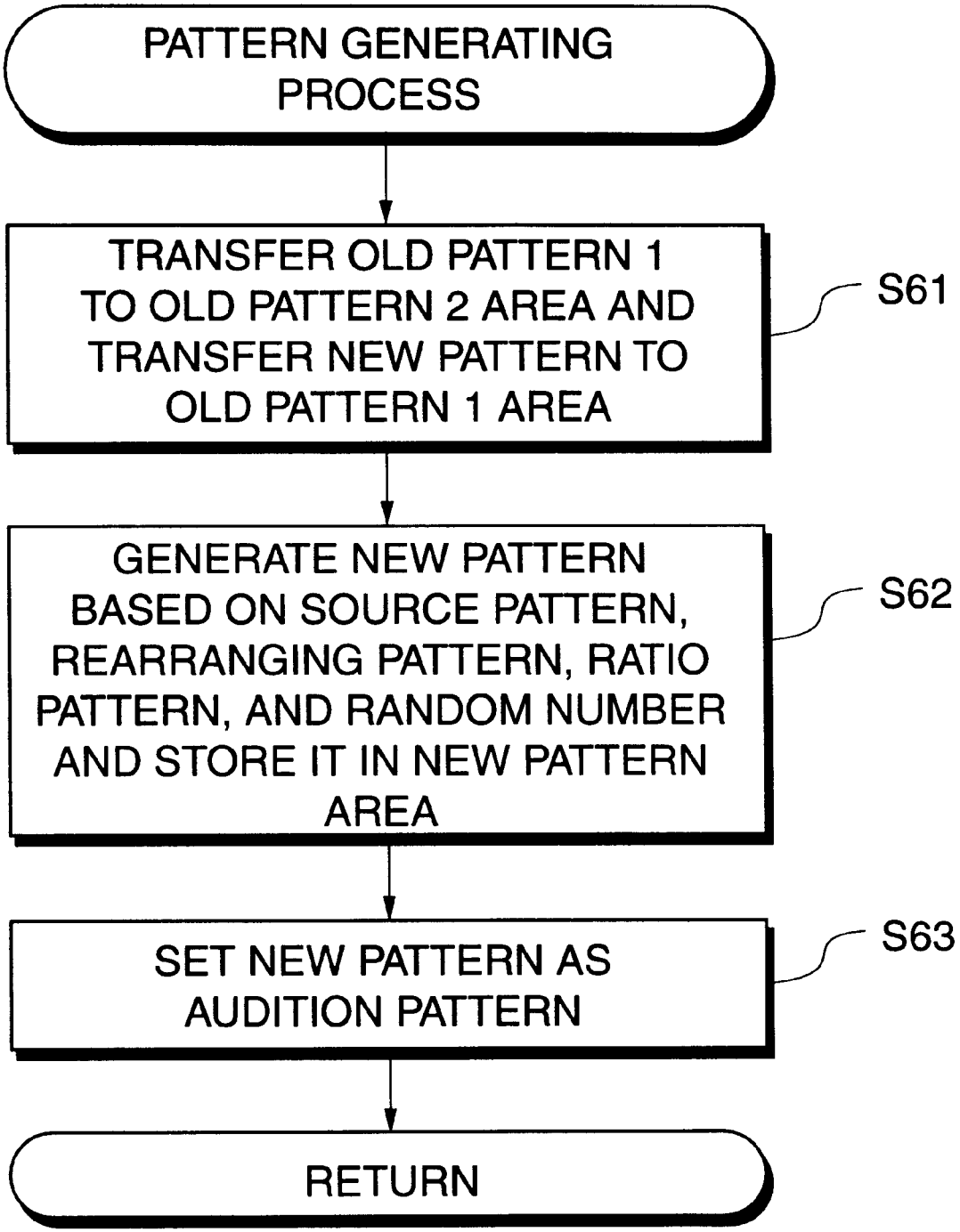
FIG. 13 is a flow chart showing details of a pattern generating process in FIG. 9.

FIG. 13 is a flow chart showing details of the pattern generating process.

In FIG. 13, first, an old pattern 1 is transferred to an old pattern 2 area, and a new pattern is transferred to an old pattern 1 area (step S61).

The old pattern 1 is stored in the old pattern 1 area of a generated pattern area, which is provided in the RAM 7 at a predetermined location, and the new pattern is stored in a new pattern area of the generated pattern area. As shown in FIG. 3, the generated pattern area is comprised of three areas: the new pattern area, the old pattern 1 area, and the old pattern 2 area. That is, at the step S61, in order to store in the new pattern area a new pattern to be generated by this pattern generating process, the last new pattern and the new pattern preceding the last new pattern are transferred to the old pattern 1 and 2 areas, respectively.

At a subsequent step S62, a new pattern is generated based on a source pattern (a pattern stored in the source pattern area), a rearranging pattern (a pattern stored in the rearranging pattern area), a ratio pattern (a pattern stored in the ratio pattern area), and a random number (generated when, for example, the CPU 5 executes a predetermined random number generation algorithm) and is stored in the new pattern area.

Then, at a step S63, the new pattern generated at the step S62 is set as an audition pattern, that is, a pattern to be subjected to the auditing process, which will be described below.

Figure 18:
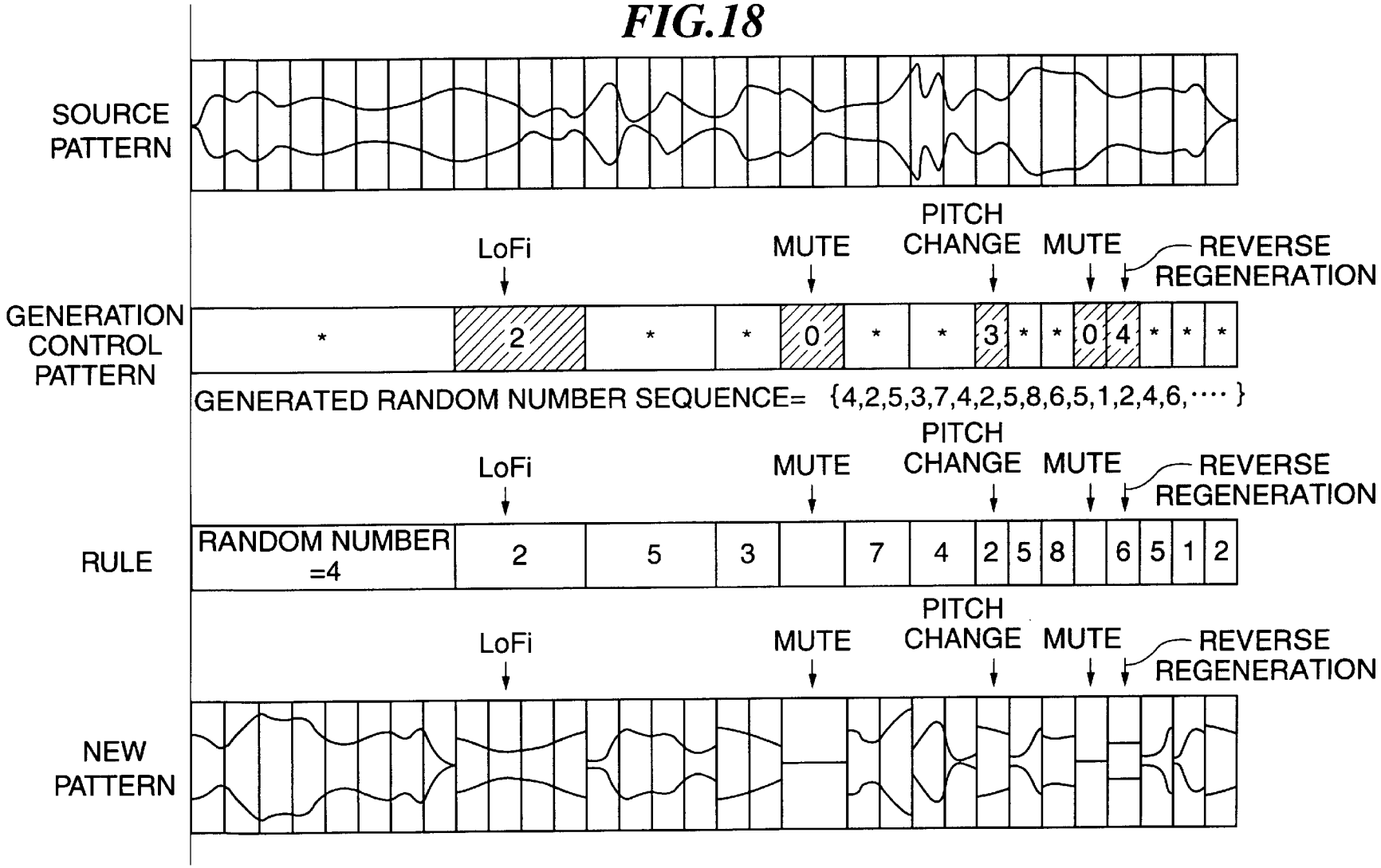
FIG. 18 is a view showing an example of generation of a new pattern from an original pattern using the pattern generating process of FIG. 13.

FIG. 18 shows an example of generation of a new pattern from a source pattern using the pattern generating process.

In the illustrated example, the pattern in FIG. 8C is used as a generation control pattern. FIG. 18 also shows a rule used to generate the new pattern.

5) The auditing process comprises regenerating a musical tone pattern selected as an audition pattern. When the musical tone pattern is waveform data obtained by sampling a sound from a musical instrument or cutting out musical tone waveform data recorded on a music CD or the like, the waveform data in this pattern is directly regenerated. When the musical tone pattern is a sequence of MIDI data such as a rhythm pattern, that is, a sequence data consisting of event data and output timing data therefor, this pattern is regenerated by outputting corresponding event data to the tone generator circuit 15 at a point of time indicated by the output timing.

Figure 14:
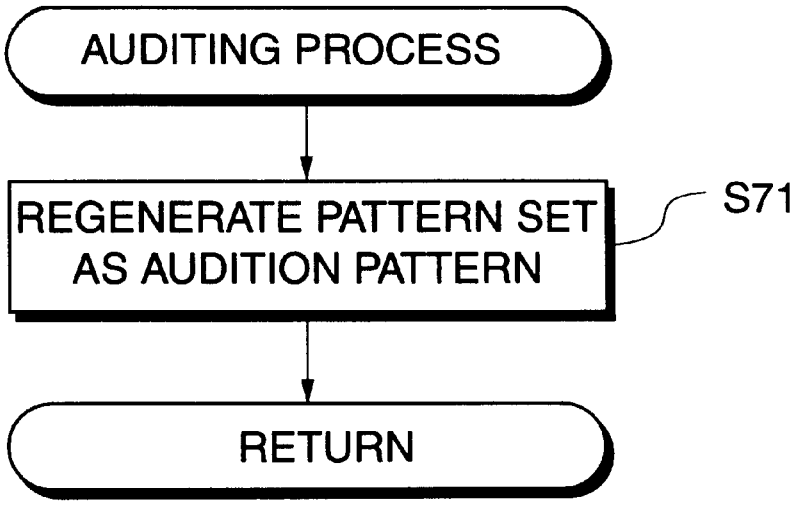
FIG. 14 is a flow chart showing details of an auditing process in FIG. 9.

FIG. 14 is a flow chart showing details of the auditing process. A pattern set as the audition pattern, that is, the audition pattern set at the above step S63, or an audition pattern selected by the audition pattern selecting process, which will be described next, is regenerated and auditioned by the above method (step S71).

6) The audition pattern selecting process comprises selecting one of the musical tone patterns stored in the three areas of the generated pattern area which is selected by the user by operating the audition PTN selecting switch 2*f*, as the audition pattern, that is, the musical tone pattern regenerated by the above auditing process.

Figure 15:
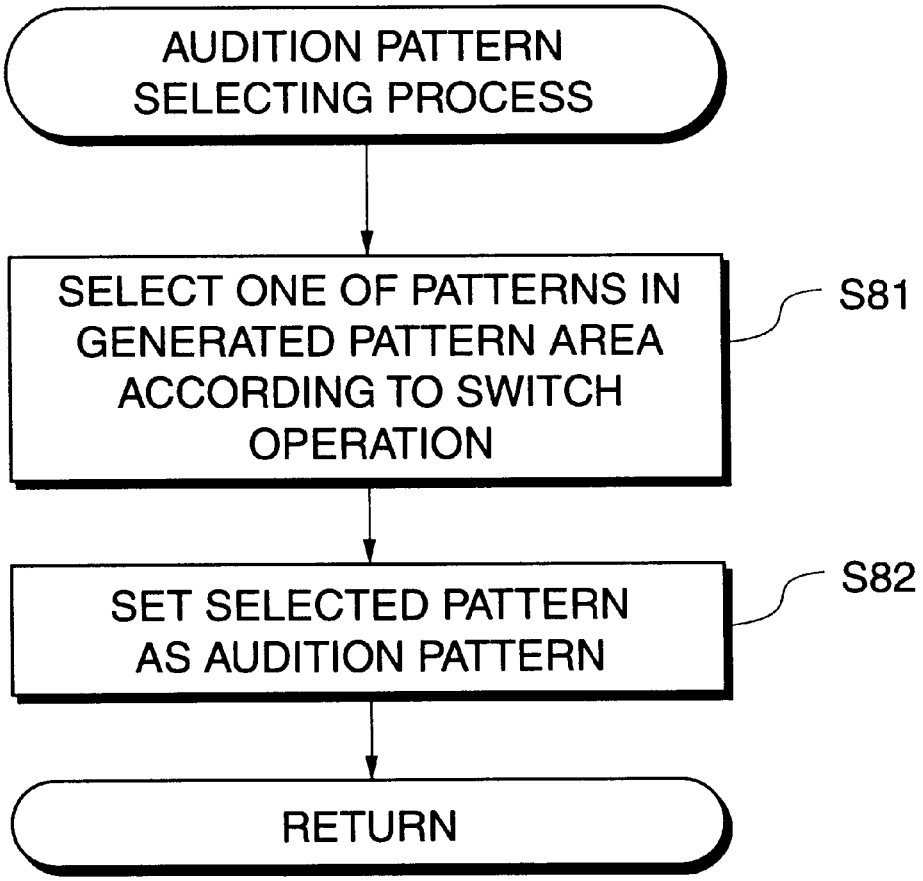
FIG. 15 is a flow chart showing details of an audition pattern selecting process in FIG. 9.

FIG. 15 is a flow chart showing details of the audition pattern selecting process. When the user operates the audition PTN selecting switch 2*f*, one of the patterns within the generated pattern area is selected according to this switch operation (step S82). Then, the selected pattern is set as the audition pattern (step S82).

7) The save process comprises shifting the current mode to the above save mode (save screen).

Figure 16:
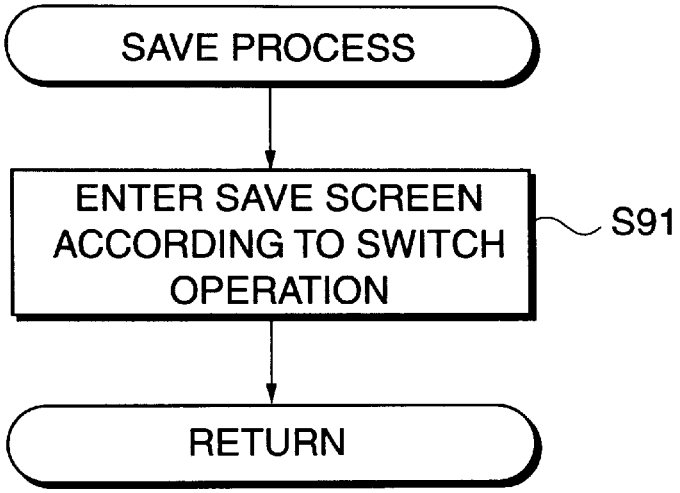
FIG. 16 is a flow chart showing details of a save process in FIG. 9.

FIG. 16 is a flow chart showing details of this save process. When the user operates the save switch 2*g*, the display device 9 shifts to the save screen (step S91).

After shifting to the save screen, the display device 9 displays, for example, a message "Specify Save Destination". At this point, operating the source PTN selecting switch 2*a* enables one of the areas within the pattern area to be selected as the saving destination; for example, the display will be "Saving Destination: Pattern 3". Alternatively, operating the rearranging PTN selecting switch 2*b* enables a user rule area in the table area to be selected as the saving destination; for example, the display will be "Saving Destination: Rule 3".

8) The save executing process comprises commanding the saving destination set by the save mode to save a simultaneously set saving object (a musical tone pattern or its generation manner).

Figure 17:
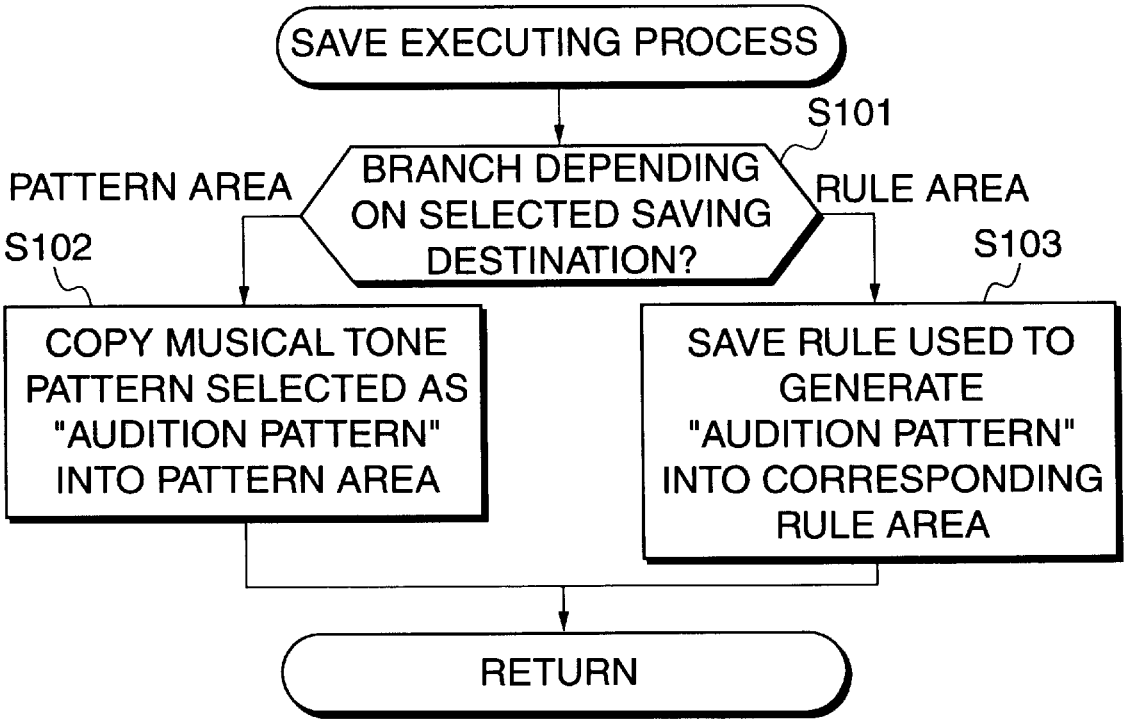
FIG. 17 is a flow chart showing details of a save executing process in FIG. 9.

FIG. 17 is a flow chart showing details of this save executing process. First, the process branches depending on whether the selected saving destination is a pattern area or the user rule area in the table area (step S101). When a pattern area has been selected, the musical tone pattern selected as the "audition pattern" is copied into this pattern area (step S102), and when the user rule area has been selected, the rule used to generate the "audition pattern" is saved into this user rule area.

If there is no empty area, one of the patterns or rules stored in the pattern area or user rule area, respectively, may be deleted so that the musical tone pattern can be copied or saved into the resulting empty area.

In the present embodiment, a new musical tone pattern is generated by directly (or after processing) rearranging the musical tone piece data of one source pattern, but the present invention is not limited to this. A new musical tone pattern maybe generated by rearranging or combining musical tone piece data of a plurality of source patterns. For example, a new musical tone pattern composed of musical tone-piece data "aklcjhgo" may be generated from a source pattern composed of musical tone piece data "abcdefgh" and a source pattern composed of musical tone piece data "ijklmnop". This can be simply realized in the same manner as in the present embodiment by employing a rearranging pattern that is composed of musical tone piece data to be rearranged, which can be selected from a plurality of source patterns.

Although in the present embodiment, as the source pattern, musical tone waveform data for one bar or MIDI sequence data for one bar, originally having rhythmicity, groove and tempo, are used, which are rearranged to generate a new pattern while maintaining the groove and tempo of the source pattern, a source pattern originally having no rhythmicity, groove or tempo may be rearranged. Further, the source pattern may have an arbitrary length instead of one bar. For example, a source pattern may be rearranged which is sampled (the length may or may not be one bar) from a sustained instrument sound or a human voice phrase (a song or a speech), or basic waveform data such as sine or saw-tooth wave for use in a waveform memory tone generator or an FM (frequency modulation) tone generator for forming musical tone signals or musical tone. waveform data obtained by sampling an instrument sound, (which may be one cycle of waveform, plural cycles of waveform, or a waveform shorter than one cycle).

In addition, in the present embodiment, the newly generated musical tone pattern is saved in the same data format as the source pattern (if, for example, the source pattern is of an audio waveform data format, the new musical tone pattern will also be of the audio waveform data format, and if, for example, the source pattern is of a MIDI sequence data format, the new musical tone pattern will also be of the MIDI sequence data format), but the present invention is not limited to this. The source pattern and the new musical tone pattern may be saved in different formats (for example, instead of the section specifying information such as "abcdefgh", that is, the musical tone piece data, information indicating the positions thereof plus the corresponding original audio waveform data or MIDI sequence data may be used).

Furthermore, although the numbers of rearranging patterns and ratio patterns are six and eight, respectively, for the sake of explanation, the present invention is of course not limited to this. For example, the number of patterns may be varied depending on the number of pieces into which the source pattern is divided, or may be totally arbitrary. In addition, the number of newly generated musical tone patterns stored is not limited to three as in the present embodiment. only the latest musical tone pattern may be stored or two or four or more musical tone patterns may be stored.

The object of the present invention can also be achieved by providing a system or apparatus with a storage medium containing a software program code for realizing the functions of the above-described embodiment and reading the program code from the storage medium by a computer (or the CPU 5 and the MPU) of the system or apparatus for execution.

In this case, the program code read from the storage medium realizes the novel functions of the present invention, and the storage medium containing the program code constitutes the present invention.

Examples of the storage medium containing the program code are the floppy disk 20, a hard disk, an optical disk, a magneto optical disk, the CD-ROM 21, a CD-R, a non-volatile memory card and the ROM 6. Alternatively, the program code may be supplied from the server computer 102 through the MIDI equipment 100 and the communication network 101.

Of course, the functions of the above described embodiment can be realized not only by executing the program code read by means of the computer but also by executing a part or the whole of the actual processing by means of an operating system or the like working on the computer in accordance with commands of the program code.

Moreover, it goes without saying that the functions of the above-described embodiment can be realized by executing a part or the whole of the actual processing by means of the CPU 5 provided in a function expansion board inserted in the computer or a function expansion unit connected to the computer in accordance with commands of the program code after the program code read from the storage medium is stored in a memory provided in the function expansion board or the function expansion unit.

What is claimed is:

1. A remix apparatus comprising:

a division device that divides musical tone pattern data having a first predetermined length into a plurality of first musical tone piece data each having a second predetermined length smaller than the first predetermined length, and divides the musical tone pattern data into a plurality of second musical tone piece data each having a third predetermined length smaller than the first predetermined length and different from the second predetermined length; and a generation device that operates based on a rearranging pattern indicative of an arrangement of lengths of ones of musical tone piece data obtained by division by said division device to be rearranged in rearranging the musical tone piece data, to generate new musical tone pattern data by selecting and rearranging at least one of said plurality of first musical tone piece data in at least one position for which the rearranging pattern indicates said second predetermined length, and selecting and rearranging at least one of said plurality of second musical tone piece data in at least one position for which the rearranging pattern indicates said third predetermined length.

2. A remix device comprising:

a division device that divides musical tone data having a predetermined length into a plurality of musical tone piece data each having a length smaller than the predetermined length;

a first selection device that selects one of a plurality of rearranging patterns each indicative of an arrangement of lengths of ones of musical tone piece data obtained by division by said division device to be rearranged in rearranging the musical tone piece data;

a second selection device that selects one of a plurality of ratio patterns each indicative of positions of ones of the musical tone piece data obtained by division by said division device to be controlled in rearranging the musical tone piece data and also indicative of contents of control thereof; and a generation device that generates new musical tone pattern data by sequentially selecting ones of said plural musical tone piece data which have lengths indicated by the selected rearranging pattern, subjecting ones of the selected musical tone piece data which are located at positions indicated by the selected ratio pattern, to control having contents indicated by the selected ratio pattern, and then rearranging the controlled musical tone piece data.

3. A remix device as claimed in claim 2, wherein said control having contents indicated by the selected ratio pattern comprises changing a pitch of said ones of the selected musical tone piece data which are located at positions indicated by the selected ratio pattern.

4. A remix device as claimed in claim 2, wherein said control having contents indicated by the selected ratio pattern comprises allowing no sound to be produced without rearranging said ones of the selected musical tone piece data which are located at positions indicated by the selected ratio pattern.

5. A remix device as claimed in claim 2, wherein said control having contents indicated by the selected ratio pattern comprises reducing fidelity of said ones of the selected musical tone piece data which are located at positions indicated by the selected ratio pattern.

6. A remix device as claimed in claim 2, wherein said control having contents indicated by the selected ratio pattern comprises attenuating a volume envelope of said ones of the selected musical tone piece data which are located at positions indicated by the selected ratio pattern.

7. A remix device as claimed in claim 2, wherein said control having contents indicated by the selected ratio pattern comprises changing a volume envelope of said ones of the selected musical tone piece data which are located at positions indicated by the selected ratio pattern.

8. A remix apparatus comprising:

a division device that divides musical tone data having a predetermined length into a plurality of musical tone piece data each having a length smaller than the predetermined length; and a generation device that operates based on a rearranging pattern indicative of a rule for use in rearranging musical tone piece data obtained by division by said division device, to generate new musical tone data by sequentially rearranging musical tone piece data selected from said plurality of musical tone piece data or muting piece data indicative of sections each having an equal length to that of a corresponding one of the selected musical tone piece data.

9. A remix apparatus comprising:

a division device that divides musical tone data having a predetermined length into a plurality of musical tone piece data each having a length smaller than the predetermined length; and a generation device that operates based on a rearranging pattern indicative of a rule for use in rearranging musical tone piece data obtained by division by said division device, to generate new musical tone pattern data by sequentially rearranging musical tone piece data selected from said plurality of musical tone piece data or modified musical tone piece data generated by sampling and holding a predetermined number of samples of the selected musical tone piece data at a time.

10. A remix apparatus comprising:

a division device that divides musical tone data having a predetermined length into a plurality of musical tone piece data each having a length smaller than the predetermined length; and a generation device that operates based on a rearranging pattern indicative of a rule for use in rearranging musical tone piece data obtained by division by said division device, to generate new musical tone pattern data by sequentially rearranging musical tone piece data selected from said plurality of musical tone piece data or modified musical tone piece data generated by reducing length of sound-generating time of the selected musical tone piece data.

11. A remix device as claimed in claim 10, wherein said reducing length of sound-generating time of the selected musical tone piece data comprises attenuating a volume envelope of the selected musical tone piece data as time passes.

12. A remix apparatus comprising:

a selection device that selects first or second musical tone pattern data from a plurality of musical tone pattern data;

a division device that divides the selected first musical tone pattern data into a plurality of first musical tone piece data each having a data length smaller than that of the first musical tone pattern data and divides the selected second musical tone pattern data into a plurality of second musical tone piece data each having a data length smaller than that of the second musical tone pattern data;

a random number generation device that generates a random number;

a first generation device that operates based on a rearranging pattern indicative of a rule for use in rearranging first musical tone piece data obtained by division by said division device and on the generated random number, to rearrange first musical tone piece data selected from the plurality of first musical tone piece data to generate a new third musical tone pattern data; and a second generation device that operates based on said rearranging pattern and said random number used to generate the third musical tone pattern data, to rearrange second musical tone piece data selected from the plurality of second musical tone piece data to generate a new fourth musical tone pattern data.

13. A remix apparatus comprising:

a selection device that selects one of a plurality of musical tone pattern data;

a division device that divides the selected musical tone pattern data into a plurality of musical tone piece data each having a data length smaller than that of the selected musical tone pattern data;

a random number generation device that generates a random number;

a generation device that operates based on a rearranging pattern indicative of a rule for use in rearranging musical tone piece data obtained by division by said division device and on the generated random number, to rearrange musical tone piece data selected from the plurality of musical tone piece data to generate a new musical tone pattern data; and a storage device that stores rule data indicative of said rearranging pattern and said random number used to generate the new musical tone pattern data.

14. A remix device as claimed in claim 13, wherein said selection device selects a new one of the plurality of musical tone pattern data based on the stored rule data, and said division device divides the selected new musical tone pattern data into a plurality of musical tone pieces based on the stored rule data, and said generation device operates based on the stored rule data, to rearrange musical tone piece data selected from the plurality of musical tone piece data to generate new musical tone pattern data.

15. A remix method comprising:

a division step of dividing musical tone pattern data having a first predetermined length into a plurality of first musical tone piece data each having a second predetermined length smaller than the first predetermined length, and dividing the musical tone pattern data into a plurality of second musical tone piece data each having a third predetermined length smaller than the first predetermined length and different from the second predetermined length; and a generation step of operating based on a rearranging pattern indicative of an arrangement of lengths of ones of musical tone piece data obtained by division by said division step to be rearranged in rearranging the musical tone piece data, to generate new musical tone pattern data by selecting and rearranging at least one of said plurality of first musical tone piece data in at least one position for which the rearranging pattern indicates said second predetermined length, and selecting and rearranging at least one of said plurality of second musical tone piece data in at least one position for which the rearranging pattern indicates said third predetermined length.

16. A remix method comprising:

a division step of dividing musical tone data having a predetermined length into a plurality of musical tone piece data each having a length smaller than the predetermined length;

a first selection step of selecting one of a plurality of rearranging patterns each indicative of an arrangement of lengths of ones of musical tone piece data obtained by division by said division step to be rearranged in rearranging the musical tone piece data;

a second selection step of selecting one of a plurality of ratio patterns each indicative of positions of ones of the musical tone piece data obtained by pattern data by sequentially rearranging musical tone piece data selected from said plurality of musical tone piece data or modified musical tone piece data generated by sampling and holding a predetermined number of samples of the selected musical tone piece at a time.

17. A remix method comprising:

a division step of dividing musical tone data having a predetermined length into a plurality of musical tone piece data each having a length smaller than the predetermined length; and a generation step of operating based on a rearranging pattern indicative of a rule for use in rearranging musical tone piece data obtained by division by said division step, to generate new musical tone data by sequentially rearranging musical tone piece data selected from said plurality of musical tone piece data or muting piece data indicative of sections each having an equal length to that of a corresponding one of the selected musical tone piece data.

18. A remix method comprising:

a division step of dividing musical tone data having a predetermined length into a plurality of musical tone piece data each having a length smaller than the predetermined length; and a generation step of operating based on a rearranging pattern indicative of a rule for use in rearranging musical tone piece data obtained by division by said division step, to generate new musical tone pattern data by sequentially rearranging musical tone piece data selected from said plurality of musical tone piece data or modified musical tone piece data generated by sampling and holding a predetermined number of samples of the selected musical tone piece data at a time.

19. A remix method comprising:

a division step of dividing musical tone data having a predetermined length into a plurality of musical tone piece data each having a length smaller than the predetermined length; and a generation step of operating based on a rearranging pattern indicative of a rule for use in rearranging musical tone piece data obtained by division by said division step, to generate new musical tone pattern data by sequentially rearranging musical tone piece data selected from said plurality of musical tone piece data or modified musical tone piece data generated by reducing length of sound-generating time of the selected musical tone piece data.

20. A remix method comprising:

a selection step of selecting first or second musical tone pattern data from a plurality of musical tone pattern data;

a division step of dividing the selected first musical tone pattern data into a plurality of first musical tone piece data each having a data length smaller than that of the first musical tone pattern data and divides the selected second musical tone pattern data into a plurality of second musical tone piece data each having a data length smaller than that of the second musical tone pattern data;

a random number generation step of generating a random number;

a first generation step of operating based on a rearranging pattern indicative of a rule for use in rearranging first musical tone piece data obtained by division by said division step and on the generated random number, to rearrange first musical tone piece data selected from the plurality of first musical tone piece data to generate a new third musical tone pattern data; and a second generation step of operating based on said rearranging pattern and said random number used to generate the third musical tone pattern data, to rearrange second musical tone piece data selected from the plurality of second musical tone piece data to generate a new fourth musical tone pattern data.

21. A remix method comprising:

a selection step of selecting one of a plurality of musical tone pattern data;

a division step of dividing the selected musical tone pattern data into a plurality of musical tone piece data each having a data length smaller than that of the selected musical tone pattern data;

a random number generation step of generating a random number;

a generation step of operating based on a rearranging pattern indicative of a rule for use in rearranging musical tone piece data obtained by division by said division step and on the generated random number, to rearrange musical tone piece data selected from the plurality of musical tone piece data to generate a new musical tone pattern data; and a storage step of storing rule data indicative of said rearranging pattern and said random number used to generate the new musical tone pattern data.

22. A machine readable storage medium storing instructions for causing a machine to execute a remix method comprising:

a division step of dividing musical tone pattern data having a first predetermined length into a plurality of first musical tone piece data each having a second predetermined length smaller than the first predetermined length, and dividing the musical tone pattern data into a plurality of second musical tone piece data each having a third predetermined length smaller than the first predetermined length and different from the second predetermined length; and a generation step of operating based on a rearranging pattern indicative of an arrangement of lengths of ones of musical tone piece data obtained by division by said division step to be rearranged in rearranging the musical tone piece data, to generate new musical tone pattern data by selecting and rearranging at least one of said plurality of first musical tone piece data in at least one position for which the rearranging pattern indicates said second predetermined length, and selecting and rearranging at least one of said plurality of second musical tone piece data in at least one position for which the rearranging pattern indicates said third predetermined length.

23. A machine readable storage medium storing instructions for causing a machine to execute a remix method comprising:

a division step of dividing musical tone data having a predetermined length into a plurality of musical tone piece data each having a length smaller than the predetermined length;

a first selection step of selecting one of a plurality of rearranging patterns each indicative of an arrangement of lengths of ones of musical tone piece data obtained by division by said division step to be rearranged in rearranging the musical tone piece data;

a second selection step of selecting one of a plurality of ratio patterns each indicative of positions of ones of the musical tone piece data obtained by division by said division step to be controlled in rearranging the musical tone piece data and also indicative of contents of control thereof; and a generation step of generating new musical tone pattern data by sequentially selecting ones of said plural musical tone piece data which have lengths indicated by the selected rearranging pattern, subjecting ones of the selected musical tone piece data which are located at positions indicated by the selected ratio pattern, to control having contents indicated by the selected ratio pattern, and then rearranging the controlled musical tone piece data.

24. A machine readable storage medium storing instructions for causing a machine to execute a remix method comprising:

a division step of dividing musical tone data having a predetermined length into a plurality of musical tone piece data each having a length smaller than the predetermined length; and a generation step of operating based on a rearranging pattern indicative of a rule for use in rearranging musical tone piece data obtained by division by said division step, to generate new musical tone data by sequentially rearranging musical tone piece data selected from said plurality of musical tone piece data or muting piece data indicative of sections each having an equal length to that of a corresponding one of the selected musical tone piece data.

25. A machine readable storage medium storing instructions for causing a machine to execute a remix method comprising:

a division step of dividing musical tone data having a predetermined length into a plurality of musical tone piece data each having a length smaller than the predetermined length; and a generation step of operating based on a rearranging pattern indicative of a rule for use in rearranging musical tone piece data obtained by division by said division step, to generate new musical tone pattern data by sequentially rearranging musical tone piece data selected from said plurality of musical tone piece data or modified musical tone piece data generated by sampling and holding a predetermined number of samples of the selected musical tone piece data at a time.

26. A machine readable storage medium storing instructions for causing a machine to execute a remix method comprising:

a division step of dividing musical tone data having a predetermined length into a plurality of musical tone piece data each having a length smaller than the predetermined length; and a generation step of operating based on a rearranging pattern indicative of a rule for use in rearranging musical tone piece data obtained by division by said division step, to generate new musical tone pattern data by sequentially rearranging musical tone piece data selected from said plurality of musical tone piece data or modified musical tone piece data generated by reducing length of sound-generating time of the selected musical tone piece data.

27. A machine readable storage medium storing instructions for causing a machine to execute a remix method comprising:

a selection step of selecting first or second musical tone pattern data from a plurality of musical tone pattern data;

a division step of dividing the selected first musical tone pattern data into a plurality of first musical tone piece data each having a data length smaller than that of the first musical tone pattern data and divides the selected second musical tone pattern data into a plurality of second musical tone piece data each having a data length smaller than that of the second musical tone pattern data;

a random number generation step of generating a random number;

a first generation step of operating based on a rearranging pattern indicative of a rule for use in rearranging first musical tone piece data obtained by division by said division step and on the generated random number, to rearrange first musical tone piece data selected from the plurality of first musical tone piece data to generate a new third musical tone pattern data; and a second generation step of operating based on said rearranging pattern and said random number used to generate the third musical tone pattern data, to rearrange second musical tone piece data selected from the plurality of second musical tone piece data to generate a new fourth musical tone pattern data.

28. A machine readable storage medium storing instructions for causing a machine to execute a remix method comprising:

a selection step of selecting one of a plurality of musical tone pattern data;

a division step of dividing the selected musical tone pattern data into a plurality of musical tone piece data each having a data length smaller than that of the selected musical tone pattern data;

a random number generation step of generating a random number;

a generation step of operating based on a rearranging pattern indicative of a rule for use in rearranging musical tone piece data obtained by division by said division step and on the generated random number, to rearrange musical tone piece data selected from the plurality of musical tone piece data to generate a new musical tone pattern data; and a storage step of storing rule data indicative of said rearranging pattern and said random number used to generate the new musical tone pattern data.

* * * * *